US010005287B2

(12) United States Patent
Yamada et al.

(10) Patent No.: US 10,005,287 B2
(45) Date of Patent: Jun. 26, 2018

(54) LIQUID EJECTION APPARATUS, LIQUID EJECTION HEAD, AND METHOD OF SUPPLYING LIQUID

(71) Applicant: CANON KABUSHIKI KAISHA, Tokyo (JP)

(72) Inventors: Kazuhiro Yamada, Yokohama (JP); Shuzo Iwanaga, Kawasaki (JP); Seiichiro Karita, Saitama (JP); Takatsuna Aoki, Yokohama (JP); Shingo Okushima, Kawasaki (JP); Akira Yamamoto, Yokohama (JP); Zentaro Tamenaga, Sagamihara (JP); Noriyasu Nagai, Tokyo (JP); Tatsurou Mori, Yokohama (JP); Akio Saito, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/382,048

(22) Filed: Dec. 16, 2016

(65) Prior Publication Data

US 2017/0197431 A1 Jul. 13, 2017

(30) Foreign Application Priority Data

Jan. 8, 2016 (JP) ..... 2016-003069
Dec. 8, 2016 (JP) ..... 2016-238889

(51) Int. Cl.
*B41J 2/175* (2006.01)

(52) U.S. Cl.
CPC ..... *B41J 2/17596* (2013.01)

(58) Field of Classification Search
CPC ..... B41J 2/18; B41J 2/17596; B41J 2202/12
See application file for complete search history.

(56) References Cited

U.S. PATENT DOCUMENTS

| | | | | |
|---|---|---|---|---|
| 4,737,801 | A | 4/1988 | Ichihashi et al. | 347/85 |
| 4,748,459 | A | 5/1988 | Ichihashi et al. | 347/31 |
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |

(Continued)

FOREIGN PATENT DOCUMENTS

| | | |
|---|---|---|
| JP | 2005-271337 | 10/2005 |
| JP | 2014-141032 | 8/2014 |

OTHER PUBLICATIONS

U.S. Appl. No. 15/382,027, filed Dec. 16, 2016.

(Continued)

*Primary Examiner* — Juanita D Jackson
(74) *Attorney, Agent, or Firm* — Fitzpatrick, Cella, Harper & Scinto

(57) ABSTRACT

A liquid ejection apparatus using a liquid ejection head and ejecting a liquid from the liquid ejection head includes a liquid supply unit that has a supply passage of the liquid supplied to the liquid ejection head and a collection passage of the liquid collected from the liquid ejection head, and supplies and collects the liquid by generating a difference between a pressure of the liquid in the supply passage and a pressure of the liquid in the collection passage, and a flow resistance adjustment unit provided in the supply passage and/or the collection passage.

22 Claims, 27 Drawing Sheets

(56) References Cited

U.S. PATENT DOCUMENTS

| | | | | |
|---|---|---|---|---|
| 5,166,707 | A | 11/1992 | Watanabe et al. | 347/3 |
| 5,189,443 | A | 2/1993 | Arashima et al. | 347/63 |
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A | 3/1994 | Nozawa et al. | 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |
| 2013/0106963 | A1* | 5/2013 | Kawase | B41J 2/17509 347/85 |

OTHER PUBLICATIONS

U.S. Appl. No. 15/387,340, filed Dec. 21, 2016.
U.S. Appl. No. 15/387,334, filed Dec. 21, 2016.
U.S. Appl. No. 15/382,039, filed Dec. 16, 2016.
U.S. Appl. No. 15/380,584, filed Dec. 15, 2016.

* cited by examiner

LIQUID EJECTION APPARATUS, LIQUID EJECTION HEAD, AND METHOD OF SUPPLYING LIQUID

BACKGROUND OF THE INVENTION

Field of the Invention

The present invention relates to a liquid ejection apparatus, a liquid ejection head, and a method of supplying a liquid, and specifically relates to a liquid supply mechanism that supplies a liquid to a passage in a liquid ejection head by generating a pressure difference between a supply side and a collection side.

Description of the Related Art

Japanese Patent Laid-Open No. 2014-141032 describes that a liquid flow is generated in a liquid passage, in which an energy generation element is provided, communicating with an ejection opening of a liquid ejection head. In this way, for example, a liquid (ink) having increased viscosity around the ejection opening is discharged, and an ejection characteristic is prevented from being degraded. In the Japanese Patent Laid-Open No. 2014-141032, two types of pressure adjustment tanks, control pressure of which are set to be different from each other, in a supply path and a collection path of the liquid in the liquid ejection head respectively are used to control pressures in a liquid supply path at an upstream side and a downstream side of the liquid ejection head to be constant. Thereby, the ink flow is generated in the passage of the liquid ejection head by a predetermined differential pressure between the supply path and the collection path.

In a long head such as a line-type head, the number of ejection openings increases, and thus the supply amount of ink to the head increases. For this reason, a flow amount fluctuation or a difference in pressure loss inside the liquid ejection head, generated due to a fluctuation in ejection duty depending on printed data, etc. increases. As a result, there is concern that a negative pressure around the ejection opening greatly varies, and thus the volume of ejected liquid droplets may change, and a defect such as uneven density of an image may be generated.

For this problem, in the Japanese Patent Laid-Open No. 2014-141032, the two pressure adjustment tanks operates to generate the predetermined differential pressure between the supply path and the collection path with respect to the liquid ejection head. However, the predetermined differential pressure cannot be generated in a case where an error occurs in a resistance set for each of the supply path and the collection path, or an error in the resistance over time occurs (hereinafter these errors from set values will be referred to as "tolerances").

SUMMARY OF THE INVENTION

An object of the invention is to provide a liquid ejection apparatus and a method of supplying a liquid that are capable of generating a predetermined differential pressure between a supply path and a collection path even if a resistance set for each of the supply path and the collection path varies.

In a first aspect of the present invention, there is provided a liquid ejection apparatus that uses a liquid ejection head including at least one print element board, and ejects a liquid from the liquid ejection head, the liquid ejection apparatus including: differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage.

In a second aspect of the present invention, there is provided a method of supplying a liquid in a liquid ejection apparatus that uses a liquid ejection head and ejects a liquid from the liquid ejection head, the liquid ejection apparatus including differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, the method including: a first step of measuring a pressure at an inlet portion of the supply passage and/or the collection passage at a first flow amount; a second step of measuring a pressure at the inlet portion of the supply passage and/or the collection passage at a second flow amount larger than the first flow amount; and a third step of adjusting a flow resistance in a passage from a negative pressure control unit of the differential pressure generating unit to the inlet portion of the supply passage and/or the inlet portion of the collection passage using the flow resistance adjustment unit such that the pressure at the inlet portion of the supply passage and/or the collection passage at the second flow amount approaches the pressure at the first flow amount, wherein the liquid is supplied by the differential pressure generating unit at the pressure adjusted in the third step.

In a third aspect of the present invention, there is provided a method of supplying a liquid in a liquid ejection apparatus that uses a liquid ejection head and ejects a liquid from the liquid ejection head, the liquid ejection apparatus including differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, the method including: a first step of measuring a pressure at an outlet of the supply passage and/or the collection passage at a first flow amount; a second step of measuring a pressure at the outlet of the supply passage and/or the collection passage at a second flow amount larger than the first flow amount; and a third step of adjusting a flow resistance in a passage from a negative pressure control unit of the differential pressure generating unit to the outlet of the supply passage and/or the outlet of the collection passage using the flow resistance adjustment unit such that the pressure at the outlet of the supply passage and/or the collection passage at the second flow amount approaches the pressure at the first flow amount, wherein the liquid is supplied by the differential pressure generating unit at the pressure adjusted in the third step.

In a fourth aspect of the present invention, there is provided a liquid ejection head including: a print element board including a print element that generates energy used to eject a liquid; differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage.

According to the above configuration, it is possible to generate a predetermined differential pressure between a supply path and a collection path with respect to a liquid ejection head even when a resistance set for each of the supply path and the collection path varies in liquid supply of a liquid ejection apparatus.

Further features of the present invention will become apparent from the following description of exemplary embodiments (with reference to the attached drawings).

DESCRIPTION OF THE EMBODIMENTS

Hereinafter, embodiments and embodiments to which the present invention is applied will be described with reference to the drawings. Additionally, a liquid ejection head that ejects liquid such as ink and a liquid ejection apparatus that mounts the liquid ejection head according to the present invention can be applied to a printer, a copying machine, a facsimile having a communication system, a word processor having a printer, and an industrial printing apparatus combined with various processing devices. For example, the liquid ejection head and the liquid ejection apparatus can be used to manufacture a biochip or print an electronic circuit.

Further, since the embodiments to be described below are detailed examples of the invention, various technical limitations thereof can be made. However, embodiments of the present invention are not limited to the embodiments or the other detailed methods of the specification and can be modified within the spirit of the present invention.

(Description of Inkjet Printing Apparatus of First Embodiment)

Figure 1:
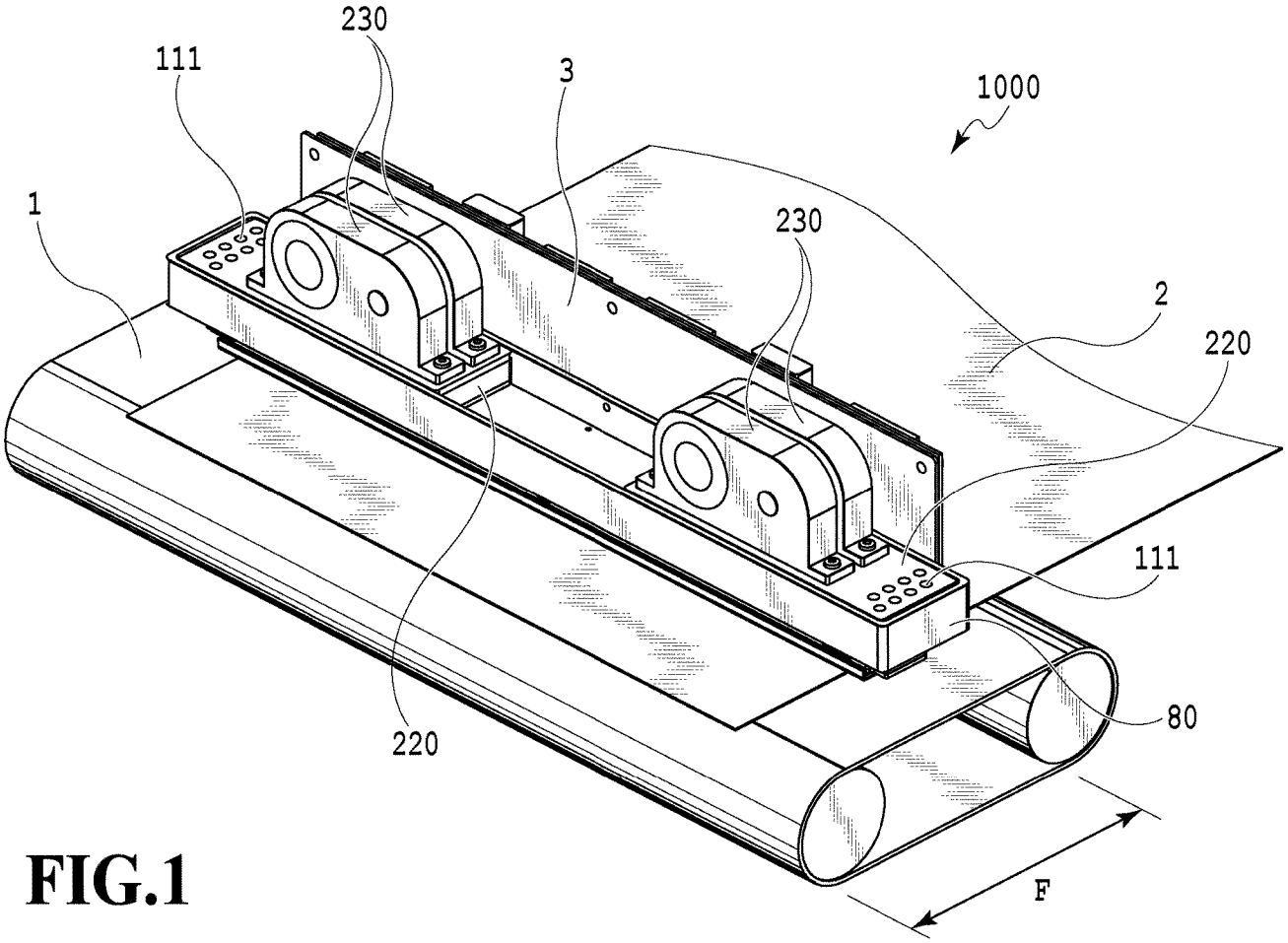
FIG. 1 is a view illustrating a schematic configuration of an ink jet printing apparatus according to an embodiment of a liquid ejection apparatus of the present invention that ejects a liquid.

FIG. 1 is a diagram illustrating a schematic configuration of a liquid ejection apparatus that ejects a liquid in the invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 is of a page wide type which has ejection openings an array length of which corresponds to a width of print medium 2. The print medium 2 is not limited to a cut sheet and may be also a continuous roll medium. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. As described later in detail, the negative pressure control unit 230, as a differential pressure generating device, generates a pressure difference between a supply passage and a collection passage provided in the liquid ejection head 3 to generate a circulation of a liquid in a pressure chamber. The liquid ejection head 3 of the embodiment ejection opening array for respectively ejecting inks of cyan C, magenta M, yellow Y, and black K and can print a full color image. The liquid ejection head 3 is fluid-connected to a liquid supply member, a main tank, and a buffer tank (see FIG. 2 to be described later) which serve as a supply path supplying a liquid to the liquid ejection head 3. Then, four negative pressure control units 230 and a liquid supply unit 220 are provided corresponding to four colors of inks. Further, the electrical control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The ink jet printing apparatus of the embodiment may be provided with two circulation configurations as a circulation mechanism for perform a circulation of a liquid. More specifically, any one of a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head can be employed. Hereinafter, the first circulation configuration and the second circulation configuration of the circulation will be described.

(Description of First Circulation Configuration)

Figure 2:
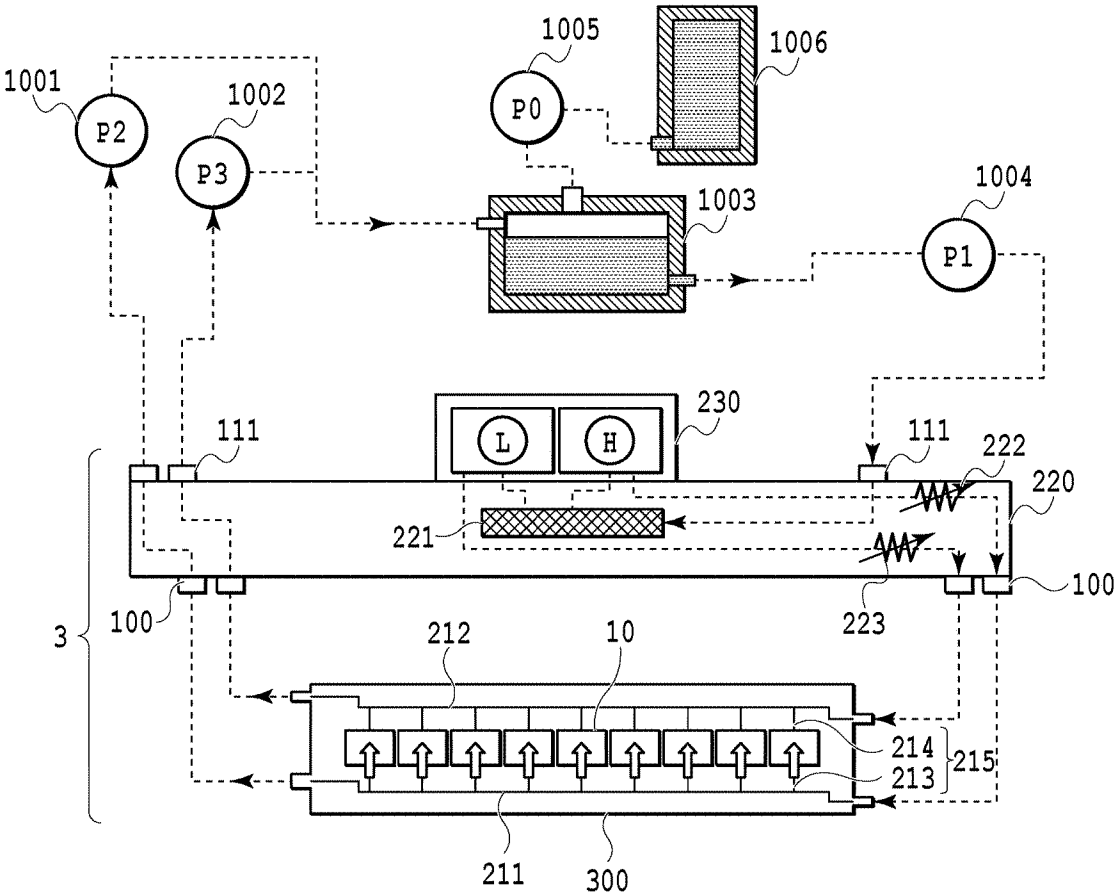
FIG. 2 is a diagram illustrating a first circulation configuration in a circulation path applied to a printing apparatus of the embodiment.

FIG. 2 is a schematic diagram illustrating the first circulation configuration in the circulation path applied to the printing apparatus 1000 of the embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 as the differential pressure generating device which is connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003. Here, the first circulation pump (the high pressure side) 1001 and the first circulation pump (the low pressure side) 1002 are not essential for composing a supply device for generating a circulation flow but are subsidiary for suppressing pressure loss or the like.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow amount. When the liquid ejection head 3 is driven, the first circulation pump (the high pressure side) 1001 and the first circulation pump (the low pressure side) 1002 are operated so that the ink flows at a predetermined flow amount through a common supply passage 211 and a common collection passage 212. Since the ink flows in this way, the temperature of the liquid ejection head 3 during a printing operation is kept at an optimal temperature. The predetermined flow amount when the liquid ejection head 3 is driven is desirably set to be equal to or higher than a flow amount at which a difference in temperature among the print element boards 10 inside the liquid ejection head 3 does not influence printing quality. Above all, when a too high flow amount is set, a difference in negative pressure among the print element boards 10 increases due to the influence of pressure loss of the passage inside a liquid ejection unit 300 and thus unevenness in density is caused. For that reason, it is desirable to set the flow amount in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow amount of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the embodiment, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow amount used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004.

As illustrated in FIG. 2, the negative pressure control unit 230 includes two negative pressure adjustment mechanisms H, L respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300, which serves as a support member for supporting a plurality of the print element board 10, is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10. The two negative pressure adjustment mechanisms H, L are connected to passages from the liquid connection portion 111 through the filter 221.

In addition, a supply-side flow resistance adjustment mechanism 222 is provided between the common supply passage 211 and the high pressure side pressure adjustment mechanism (H) of the negative pressure control unit 230, and a collection-side flow resistance adjustment mechanism 223 is provided between the common collection passage 212 and the low pressure side pressure adjustment mechanism (L). As described later in detail, even if change in a resistance of ink flow (herein after also referred to as a "flow resistance") in the common supply passage 211 and the common collection passage 212 occurs from a set value such as a tolerance, adjusting that pressure adjustment mechanisms in response to the change allows the change to be corrected. Thereby, a change from the set value of the differential pressure between can be inhibited and thus variation in the flow amount of ink flow in a passage communicating with ejection openings can be decreased.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the embodiment can print a high-quality image at a high speed.

(Description of Second Circulation Configuration)

Figure 3:
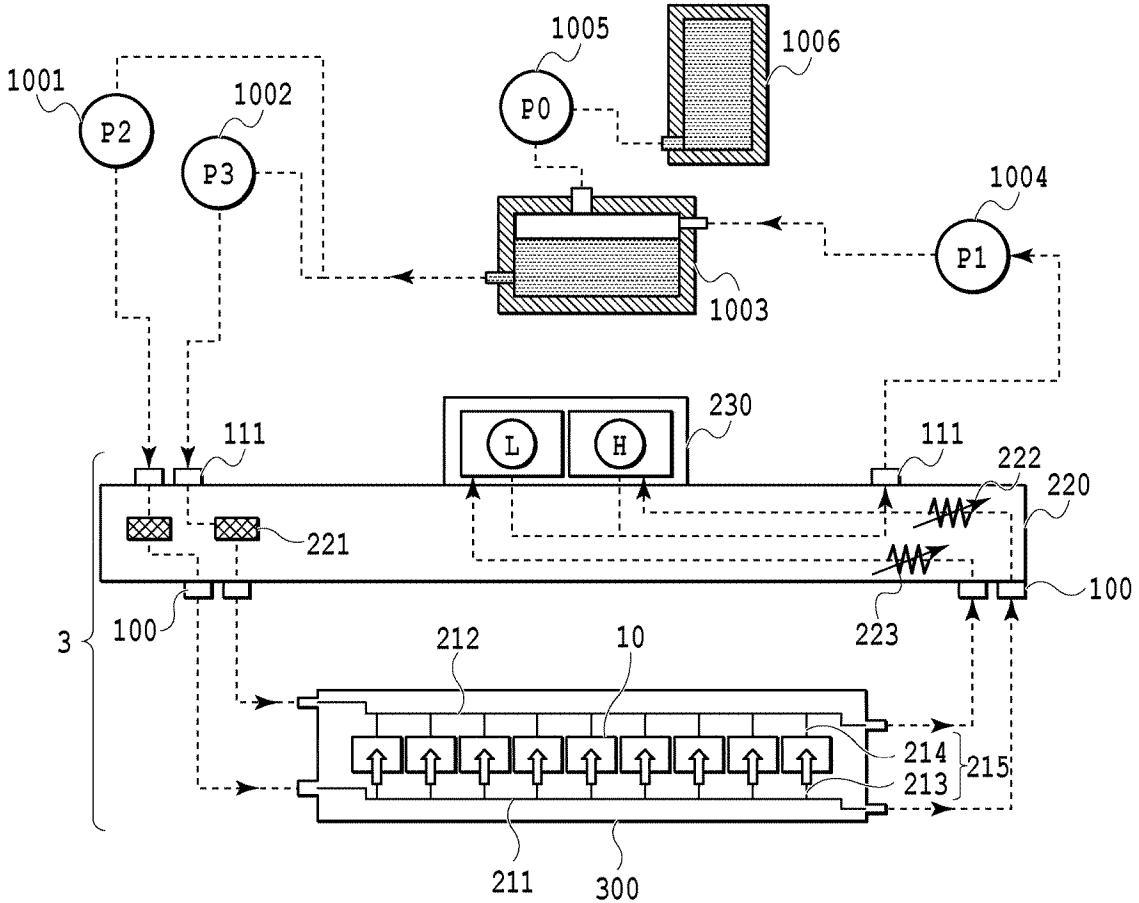
FIG. 3 is a diagram illustrating a second circulation configuration in the circulation path applied to the printing apparatus of the embodiment.

FIG. 3 is a schematic diagram illustrating the second circulation configuration which is a circulation configuration different from the first circulation configuration in the circulation path applied to the printing apparatus of the embodiment. A main difference from the first circulation configuration is that two negative pressure control mechanisms constituting the negative pressure control unit 230, which serves as a differential pressure generating device, both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, as shown in FIG. 3, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation configuration, the negative pressure control unit 230 stabilizes a change in pressure at the upstream side (that is, the liquid ejection unit 300) of the negative pressure control unit 230 within a predetermined range from a predetermined pressure even when a change in flow amount is caused by a change in ejection amount per unit area. In the circulation passage of the embodiment, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the ink is formed from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow amount necessary for the liquid from the buffer tank 1003 to the liquid ejection head 3 is smaller than that of the first circulation configuration. The reason is as below.

In the case of the circulation in the print standby state, the sum of the flow amounts of the common supply passage 211 and the common collection passage 212 is set to a flow amount A. The value of the flow amount A is defined as a minimal flow amount necessary to adjust the temperature of the liquid ejection head 3 in the print standby state so that a difference in temperature inside the liquid ejection unit 300 falls within a desired range. Further, the ejection flow amount obtained when the ink is ejected from all ejection openings of the liquid ejection unit 300 (the full ejection state) is defined as a flow amount F (the ejection amount per each ejection opening×the ejection frequency per unit time× the number of the ejection openings).

Figure 4:
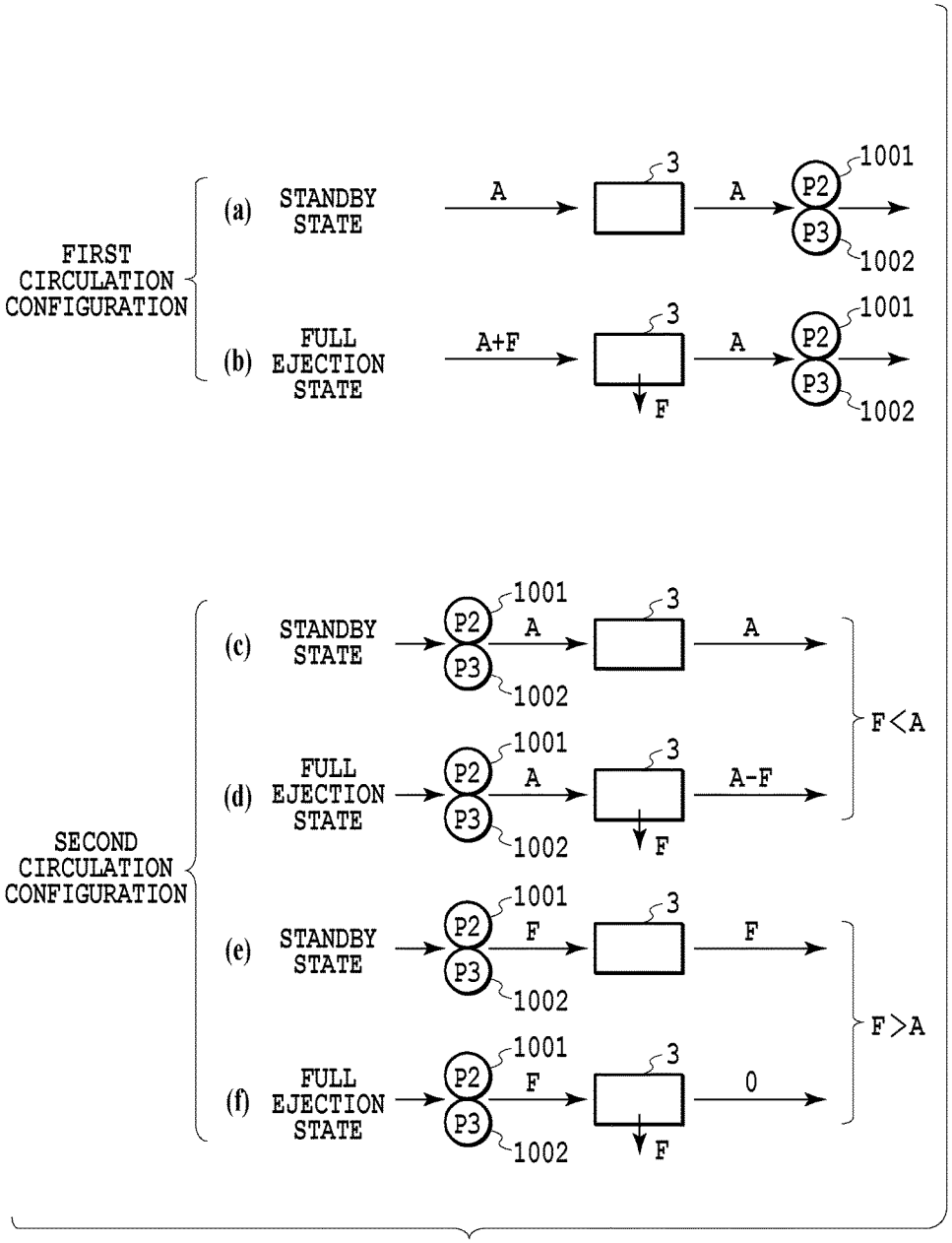
FIG. 4 is a diagram illustrating a difference in ink inflow amount to a liquid ejection head between the first circulation configuration and the second circulation configuration.

FIG. 4 is a schematic diagram illustrating a difference in ink inflow amount to the liquid ejection head between the first circulation configuration and the second circulation configuration. FIG. 4-(*a*) illustrates the standby state in the first circulation configuration and FIG. 4-(*b*) illustrates the full ejection state in the first circulation configuration. FIG. 4-(*c*) to 4-(*f*) illustrate the second circulation passage. Here, FIGS. 4-(*c*) and 4-(*d*) illustrate a case where the flow amount F is lower than the flow amount A and FIGS. 4-(*e*) and 4-(*f*) illustrate a case where the flow amount F is higher than the flow amount A. In this way, the flow amounts in the standby state and the full ejection state are illustrated.

In the case of the first circulation configuration (FIG. 4-(*a*) and FIG. 4-(*b*)) in which the first circulation pump 1001 and the first circulation pump 1002 each having a quantitative liquid delivery ability are disposed at the downstream side of the liquid ejection head 3, the total flow amount of the first circulation pump 1001 and the first circulation pump 1002 becomes the flow amount A. By the flow amount A, the temperature inside the liquid ejection unit 300 in the standby state can be managed. Then, in the case of the full ejection state of the liquid ejection head 3, the total flow amount of the first circulation pump 1001 and the first circulation pump 1002 becomes the flow amount A. However, a maximal flow amount of the liquid supplied to the liquid ejection head 3 is obtained such that the flow amount F consumed by the full ejection is added to the flow amount A of the total flow amount by the action of the negative pressure generated by the ejection of the liquid ejection head 3. Thus, a maximal value of the supply amount to the liquid ejection head 3 satisfies a relation of the flow amount A+the flow amount F since the flow amount F is added to the flow amount A (FIG. 4-(*b*)).

Meanwhile, in the case of the second circulation configuration (FIG. 4-(*c*) to FIG. 4-(*f*)) in which the first circulation pump 1001 and the first circulation pump 1002 are disposed at the upstream side of the liquid ejection head 3, the supply amount to the liquid ejection head 3 necessary for the print standby state becomes the flow amount A similarly to the first circulation configuration. Thus, when the flow amount A is higher than the flow amount F (FIG. 4-(*c*) and FIG. 4-(*d*)) in the second circulation configuration in which the first circulation pump 1001 and the first circulation pump 1002 are disposed at the upstream side of the liquid ejection head 3, the supply amount to the liquid ejection head 3 sufficiently becomes the flow amount A even in the full ejection state. At that time, the discharge flow amount of the liquid ejection head satisfies a relation of the flow amount A—the flow amount F (FIG. 4-(*d*)). However, when the flow amount F is higher than the flow amount A (FIG. 4-(*e*) and FIG. 4-(*f*)), the flow amount becomes insufficient when the flow amount of the liquid supplied to the liquid ejection head 3 becomes the flow amount A in the full ejection state. For that reason, when the flow amount F is higher than the flow amount A, the supply amount to the liquid ejection head 3 needs to be set to the flow amount F. At that time, since the flow amount F is consumed by the liquid ejection head 3 in the full ejection state, the flow amount of the liquid discharged from the liquid ejection head 3 becomes almost zero (FIG. 4-(*f*)). In addition, if the liquid is not ejected in the full ejection state when the flow amount F is higher than the flow amount A, the liquid which is attracted by the amount consumed by the ejection of the flow amount F is discharged from the liquid ejection head 3.

In this way, in the case of the second circulation configuration, the total value of the flow amounts set for the first circulation pump 1001 and the first circulation pump 1002, that is, the maximal value of the necessary supply flow amount becomes a large value among the flow amount A and the flow amount F. For this reason, as long as the liquid ejection unit 300 having the same configuration is used, the maximal value (the flow amount A or the flow amount F) of the supply amount necessary for the second circulation configuration becomes smaller than the maximal value (the flow amount A+the flow amount F) of the supply flow amount necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow amount A or the flow amount F. Accordingly, a line head having a longer longitudinal length among the line heads is beneficial.

Meanwhile, the first circulation configuration is more advantageous than the second circulation configuration. That is, in the second circulation configuration, since the flow amount of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink. Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow amount F, the minimal circulation flow amount A, and the passage resistance inside the head) of the liquid ejection head and the printing apparatus body.

As shown in FIG. 3, also in the second circulation configuration, the supply-side flow resistance adjustment mechanism 222 is provided between the common supply passage 211 and the high pressure side pressure adjustment mechanism (H) of the negative pressure control unit 230, and a collection-side flow resistance adjustment mechanism 223 is provided between the common collection passage 212 and the low pressure side pressure adjustment mechanism (L), similarly to the first circulation configuration. These flow resistance adjustment mechanisms allow a change from the set value of the differential pressure between to be inhibited.

(Description of Configuration of Liquid Ejection Head)

Figure 5A:
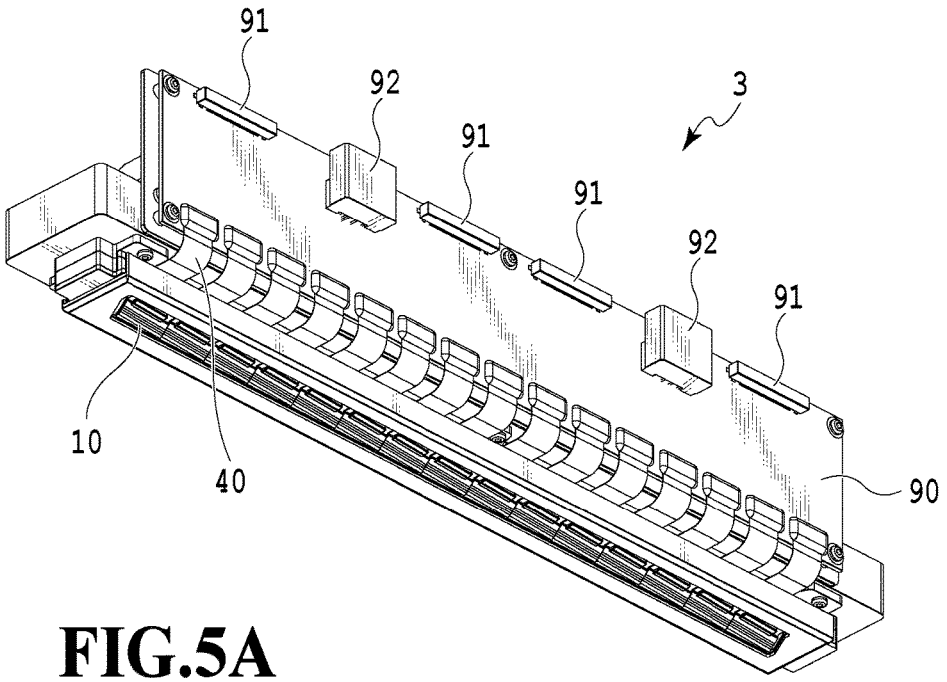
FIGS. 5A and 5B are perspective views illustrating the liquid ejection head of the embodiment.
Figure 5B:
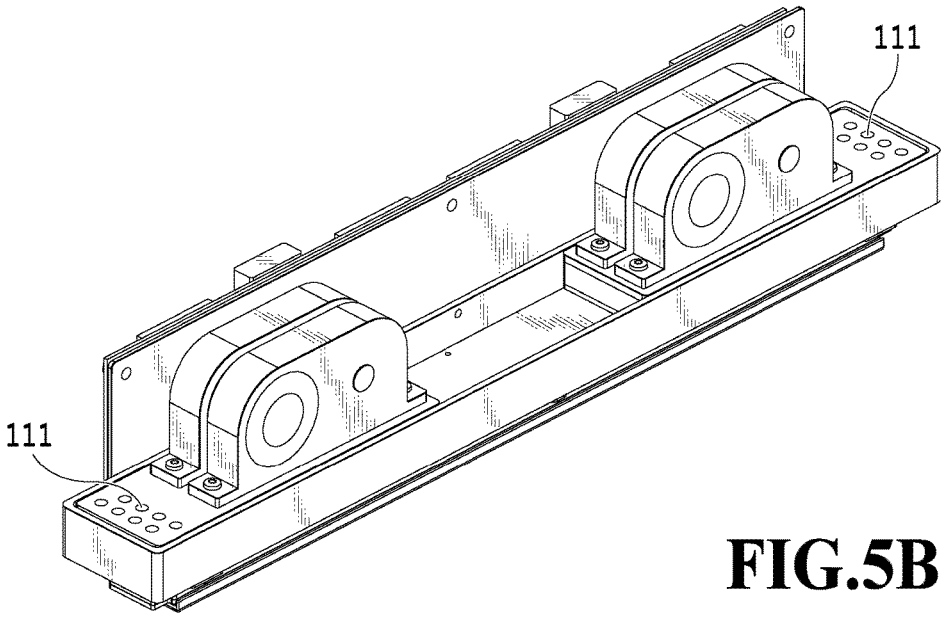

A configuration of the liquid ejection head 3 according to the first embodiment will be described. FIGS. 5A and 5B are perspective views illustrating the liquid ejection head 3 according to the embodiment. The liquid ejection head 3 is a line type liquid ejection head in which fifteen print element boards 10 capable of ejecting inks of four colors of cyan C, magenta M, yellow Y, and black K are arranged in series on one print element board (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the printing apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases. As illustrated in FIG. 5B, the liquid connection portions 111 which are provided at both ends of the liquid ejection head 3 are connected to the liquid supply system of the printing apparatus 1000. Accordingly, the inks of four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
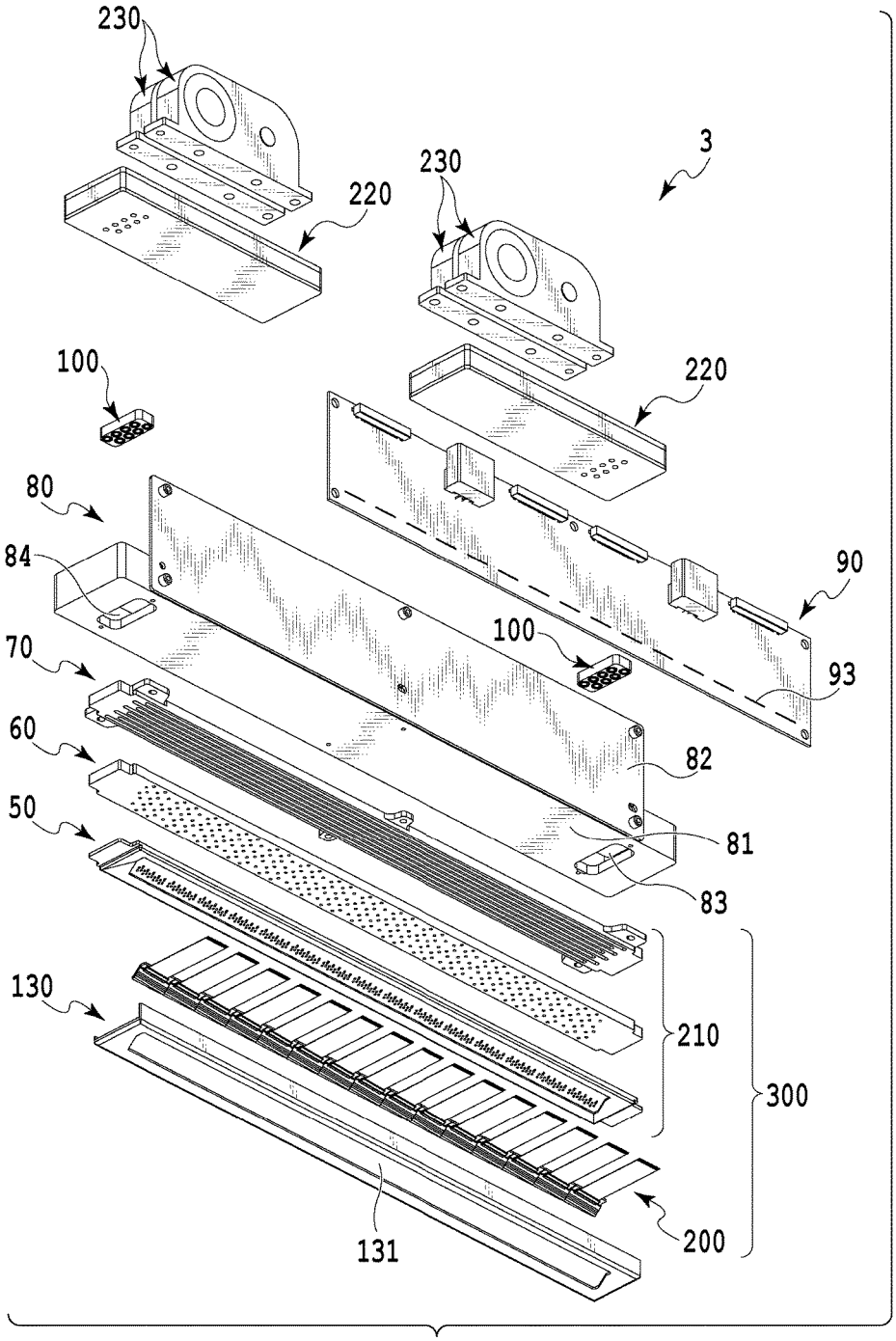
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color. The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow amount of the liquid is largely decreased. Accordingly, the negative pressure control unit 230 can stabilize a change negative pressure at the downstream side (the liquid ejection unit 300) of the negative pressure control unit within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
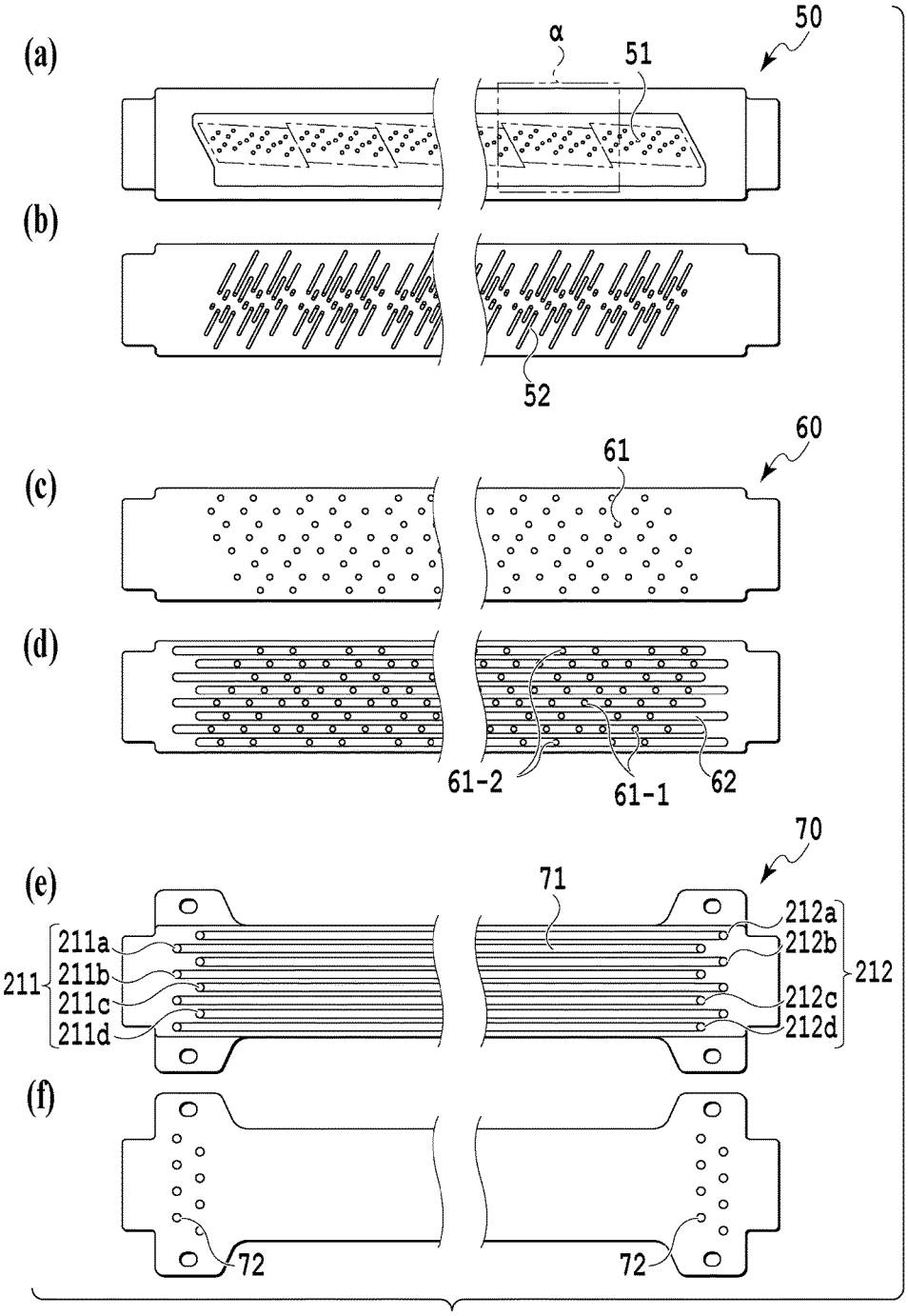
FIG. 7 is diagram illustrating front and rear faces of each of first to third passage members.

FIG. 7-(*a*) to FIG. 7-(*f*) are diagrams illustrating front and rear faces of the first to third passage members. FIG. 7-(*a*) illustrates a face onto which the ejection module 200 is mounted in the first passage member 50 and FIG. 7-(*f*) illustrates a face with which the liquid ejection unit support portion 81 comes into contact in the third passage member 70. The first passage member and the second passage member 60 are bonded to teach other so that the parts illustrated in FIG. 7-(*b*) and FIG. 7-(*c*) and corresponding to the contact faces of the passage members face each other and the second passage member and the third passage member are bonded to each other so that the parts illustrated in FIG. 7-(*d*) and FIG. 7-(*e*) and corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see FIG. 7-(*f*)) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
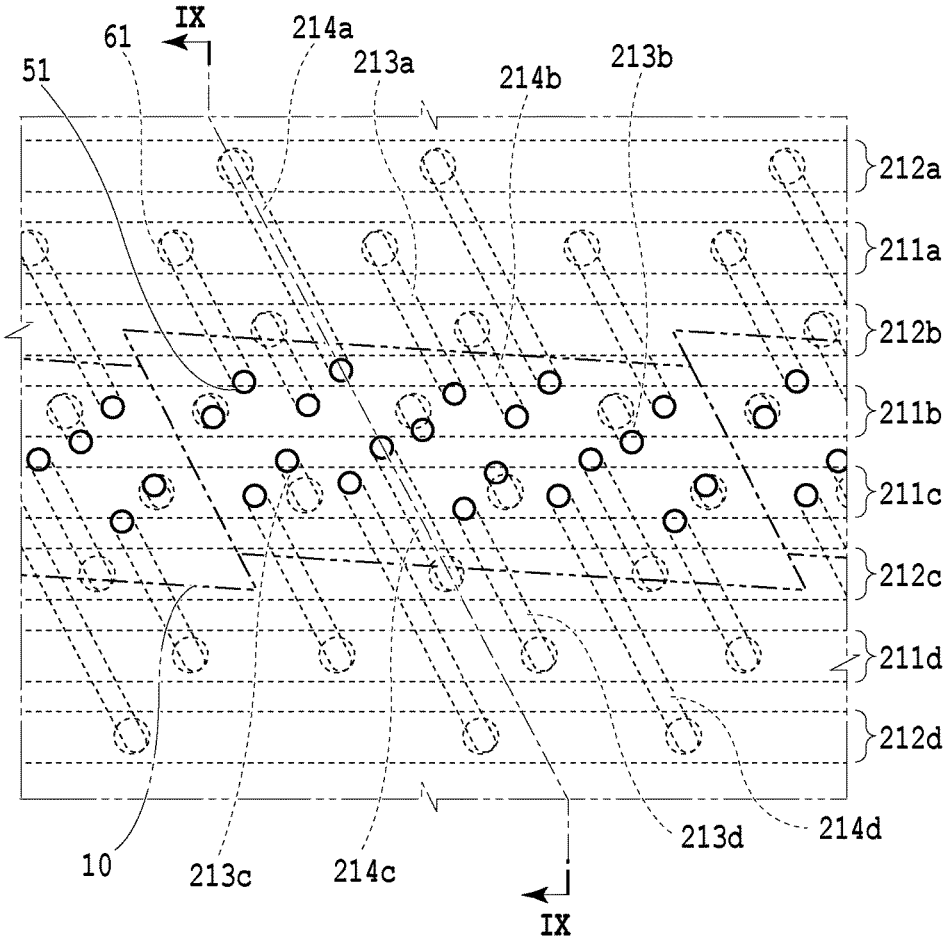
FIG. 8 is a transparent view illustrating a passage in the passage members which is formed by connecting the first to third passage members.

FIG. 8 is a partially enlarged perspective view illustrating a part α of FIG. 7-(*a*) and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
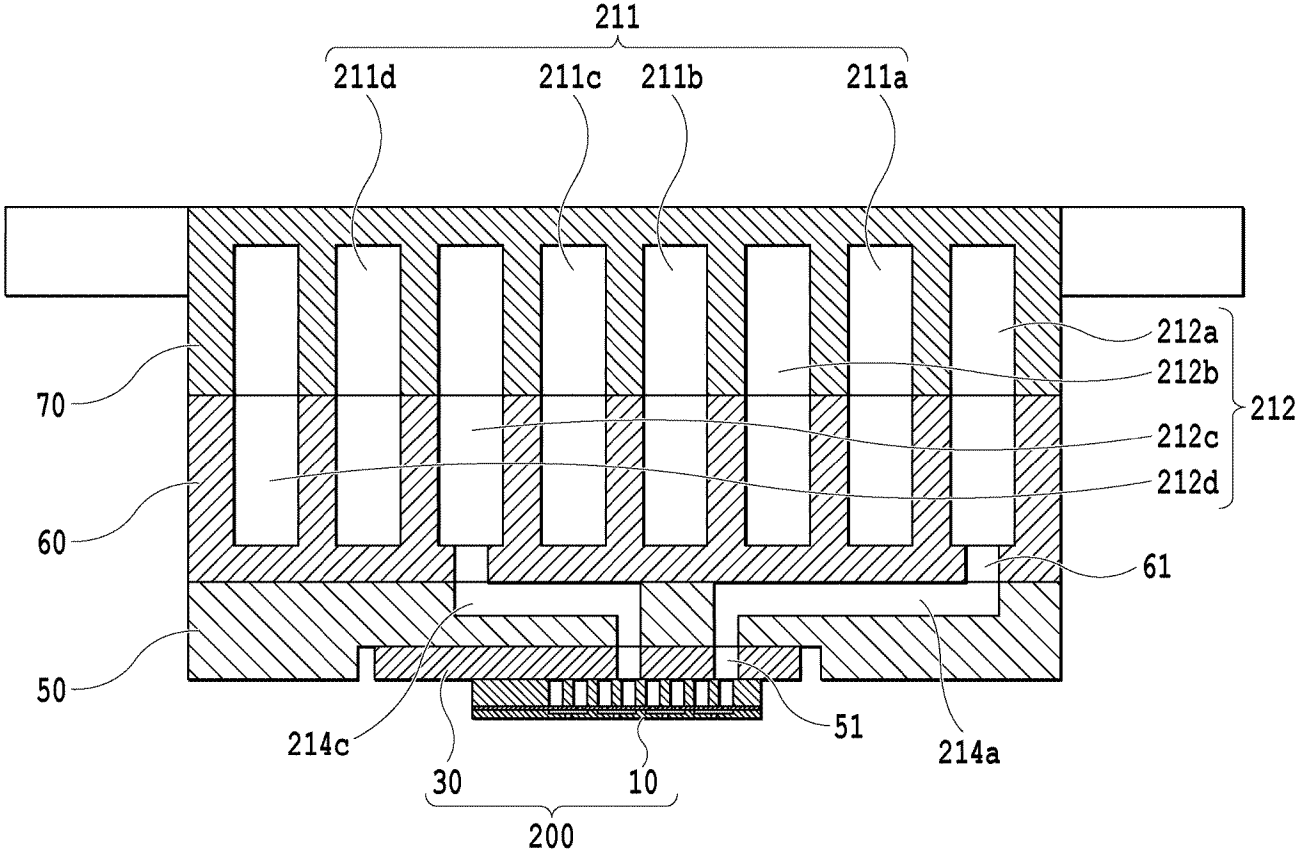
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the embodiment having the passages connected to one another.

(Description of Ejection Module)

Figure 10A:
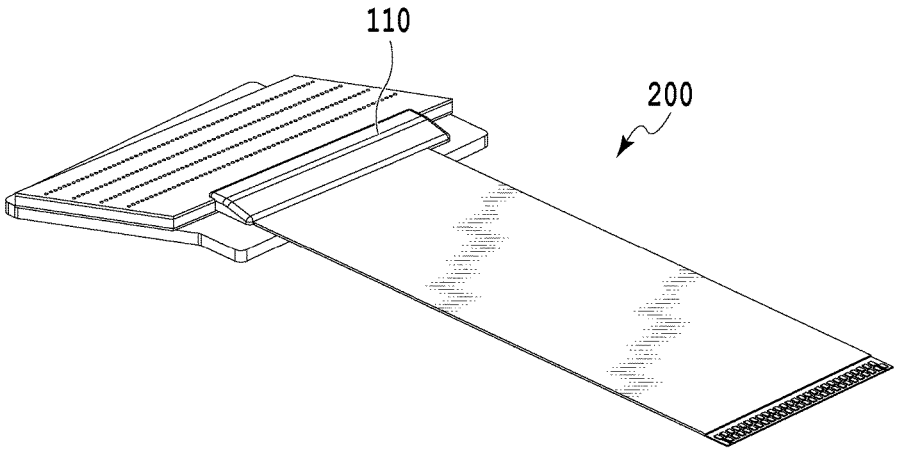
FIGS. 10A and 10B are perspective views illustrating one ejection module.
Figure 10B:
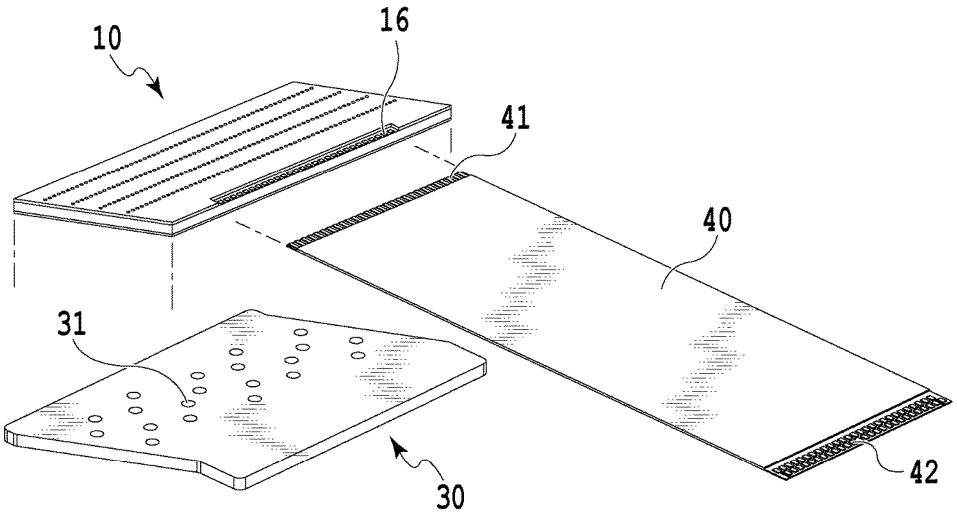

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
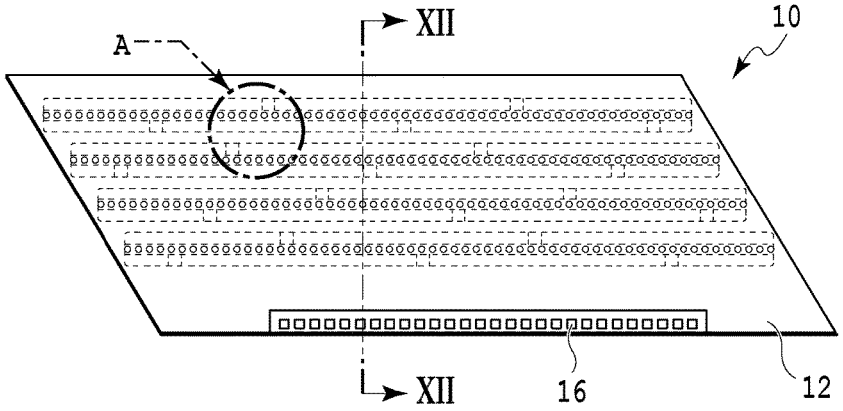
FIG. 11A is a plan view of a surface of a print element board on which ejection openings are formed.
Figure 11B:
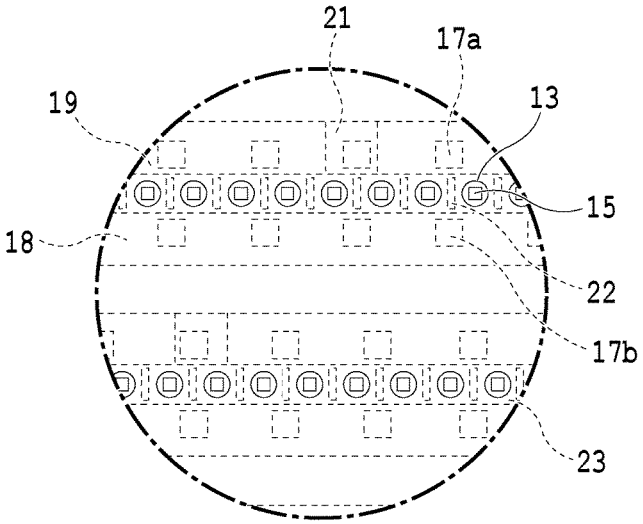
FIG. 11B is a partial enlargement view of the surface of a print element board.
Figure 11C:
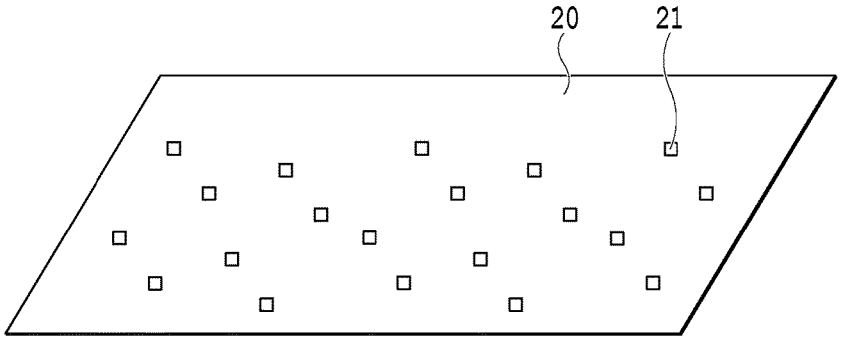
FIG. 11C is a view of opposite side of the surface of a print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board 10 of the embodiment will be described. As illustrated in FIG. 11A, an ejection opening forming member 12 of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped cover plate 20 is laminated on a rear face of a face provided with the ejection opening 13 in the print element board 10 and the cover plate 20 is provided with a plurality of openings 21 communicating with the liquid supply path 18 and the liquid collection path 19. In the embodiment, the cover plate 20 is provided with three openings 21 for each liquid supply path 18 and two openings 21 for each liquid collection path 19. As illustrated in FIG. 11B, openings 21 of the cover plate 20 communicate with the communication openings 51 illustrated in FIG. 7-(*a*). It is desirable that the cover plate 20 have sufficient corrosion resistance for the liquid. From the viewpoint of preventing mixed color, the opening shape and the opening position of the opening need to have high accuracy. For this reason, it is desirable to form the opening 21 by using a photosensitive resin material or a silicon plate as a material of the cover plate 20 through photolithography. In this way, the cover plate 20 changes the pitch of the passages by the opening 21. Here, it is desirable to form the cover plate by a film-shaped member with a thin thickness in consideration of pressure loss.

Figure 12:
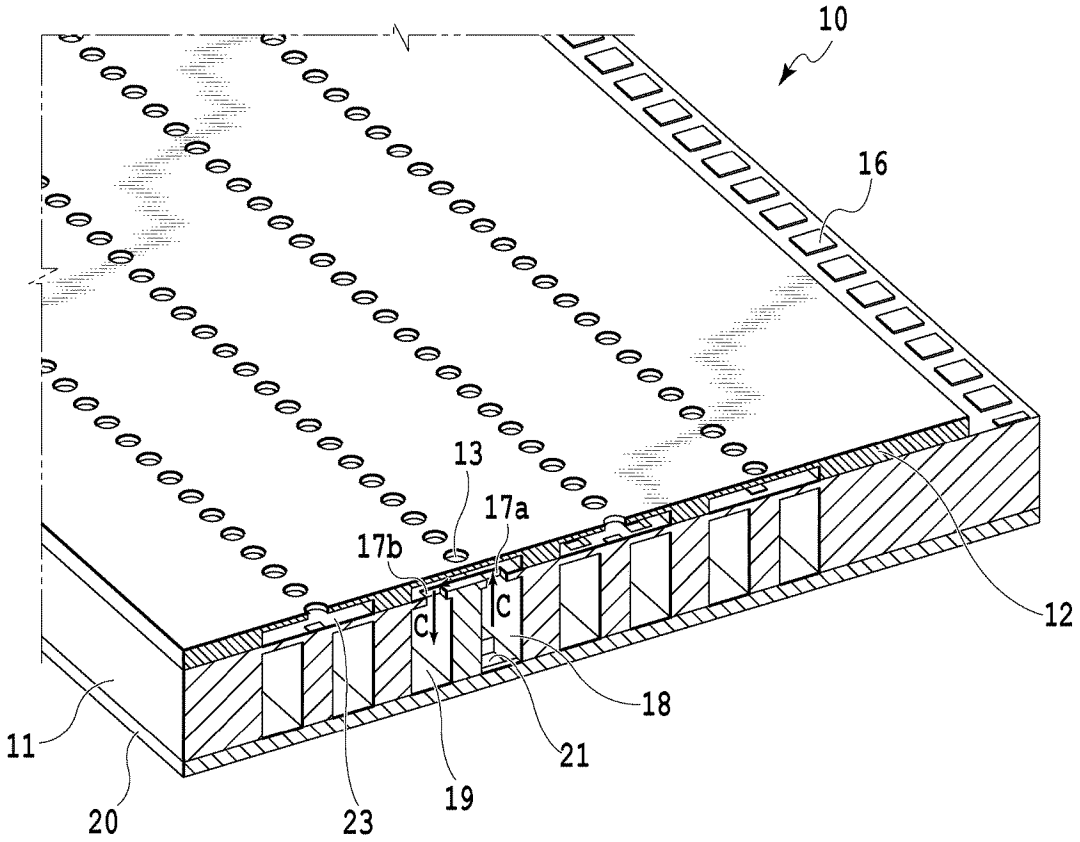
FIG. 12 is a perspective view illustrating cross-sections taken along a line XII-XII of FIG. 11A.

FIG. 12 is a perspective view illustrating cross-sections of the print element board 10 and the cover plate 20 when taken along a line XII-XII of FIG. 11A. Here, a flow of the liquid inside the print element board 10 will be described. The cover plate 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the cover plate 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the cover plate 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 (see FIG. 7-(*a*)) inside the passage member 210, the individual collection passage 214, and the common collection passage 212 through the opening 21 of the cover plate 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the cover plate 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the cover plate 20, and the liquid communication opening 31 provided in the support member 30. Subsequently, the liquid sequentially flows through the communication opening and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the joint rubber 100 through the negative pressure control unit 230. Further, in the second circulation configuration illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*. That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the embodiment. In this way, since the thickening of the liquid in the vicinity of the ejection opening or the pressure chamber 23 can be suppressed in the liquid ejection head 3 of the embodiment, a slippage or a non-ejection can be suppressed. As a result, a high-quality image can be printed.

(Description of Positional Relation Among Print Element Boards)

Figure 13:
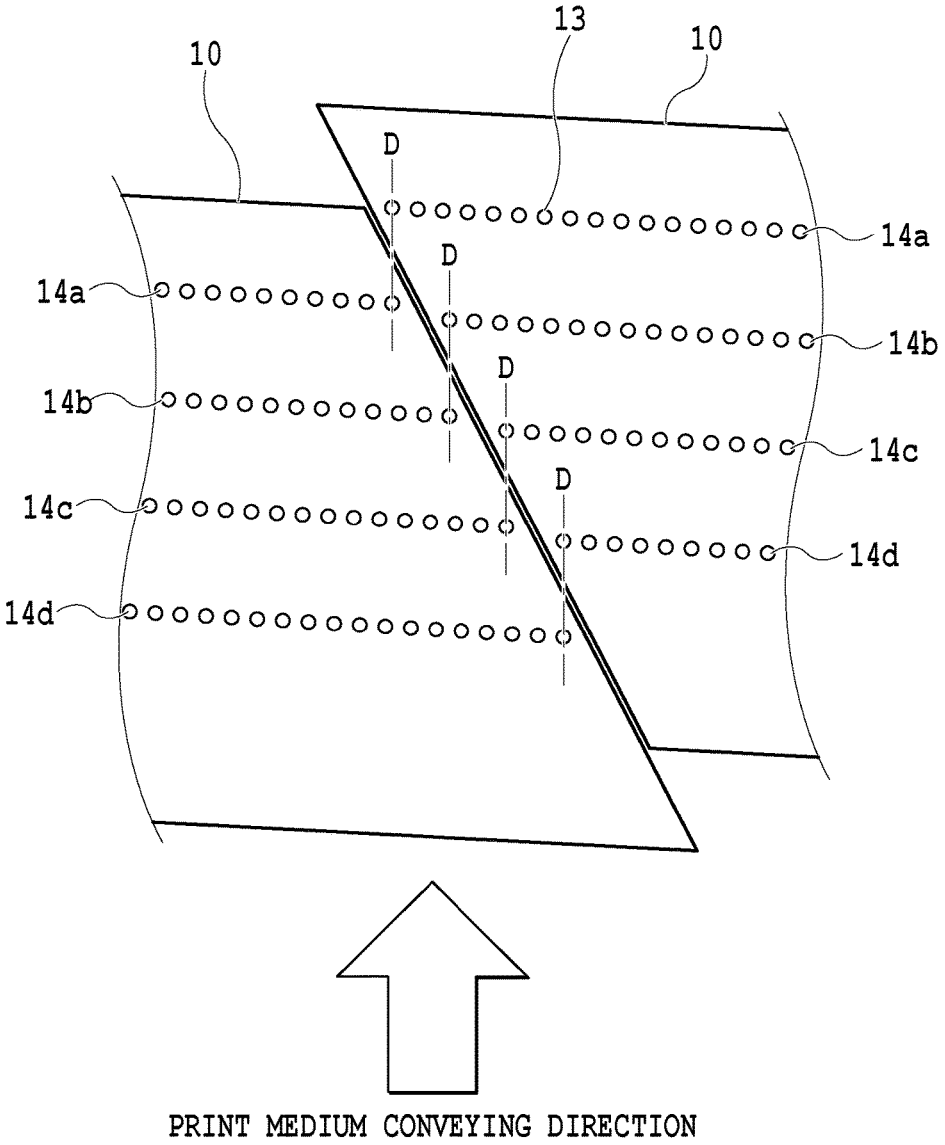
FIG. 13 is a partially enlarged plan view of an adjacent portion of adjacent two ejection modules of the print element board.

FIG. 13 is a partially enlarged top view illustrating an adjacent portion of the print element board in two adjacent ejection modules 200. In the embodiment, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the embodiment, a principal plane of the print element board has a parallelogram shape, but the invention is not limited thereto. For example, even when the print element boards having a rectangular shape, a trapezoid shape, and the other shapes are used, the configuration of the invention can be desirably used.

(Ink Jet Printing Apparatus of Second Embodiment)

Hereinafter, configurations of an inkjet printing apparatus 2000 and a liquid ejection head 2003 according to a second embodiment of the invention will be described with reference to the drawings. In the description below, only a difference from the first embodiment will be described and a description of the same components as those of the first embodiment will be omitted.

(Description of Inkjet Printing Apparatus)

Figure 21:
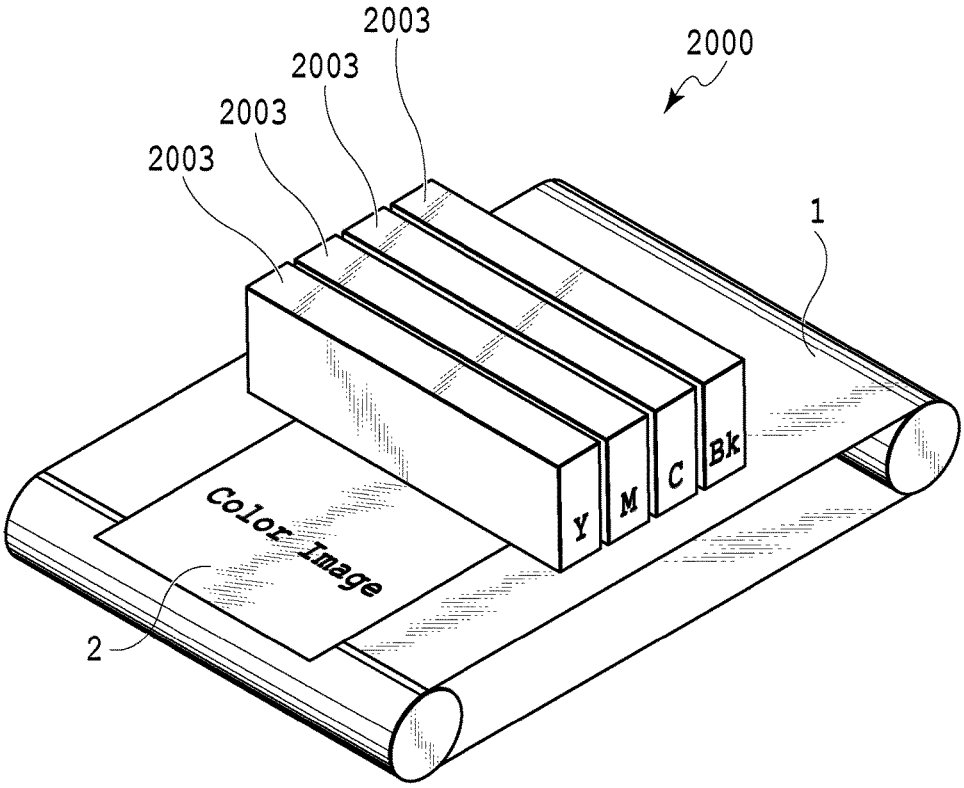
FIG. 21 is a perspective view illustrating a second embodiment of an inkjet printing apparatus according to the embodiment.

FIG. 21 is a diagram illustrating the inkjet printing apparatus 2000 according to the embodiment. The printing apparatus 2000 of the embodiment is different from the first embodiment in that a full color image is printed on the print medium by a configuration in which four monochromic liquid ejection heads 2003 respectively corresponding to the inks of cyan C, magenta M, yellow Y, and black K are disposed in parallel. In the first embodiment, the number of the ejection opening rows which can be used for one color is one. However, in the embodiment, the number of the ejection opening rows which can be used for one color is twenty. For this reason, when print data is appropriately distributed to a plurality of ejection opening rows to print an image, an image can be printed at a higher speed. Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first embodiment, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first embodiment, the first and second circulation configurations illustrated in FIG. 2 or can be used as the liquid circulation configuration between the printing apparatus 2000 and the liquid ejection head 2003.

(Description of Structure of Liquid Ejection Head)

Figure 14A:
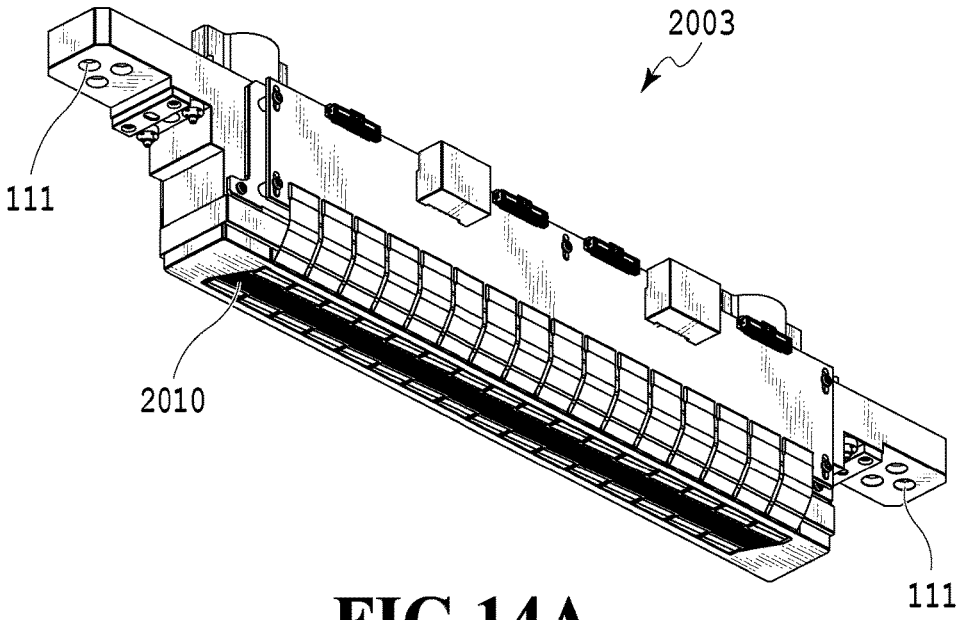
FIGS. 14A and 14B are perspective views illustrating the liquid ejection head according to other example of the embodiment.
Figure 14B:
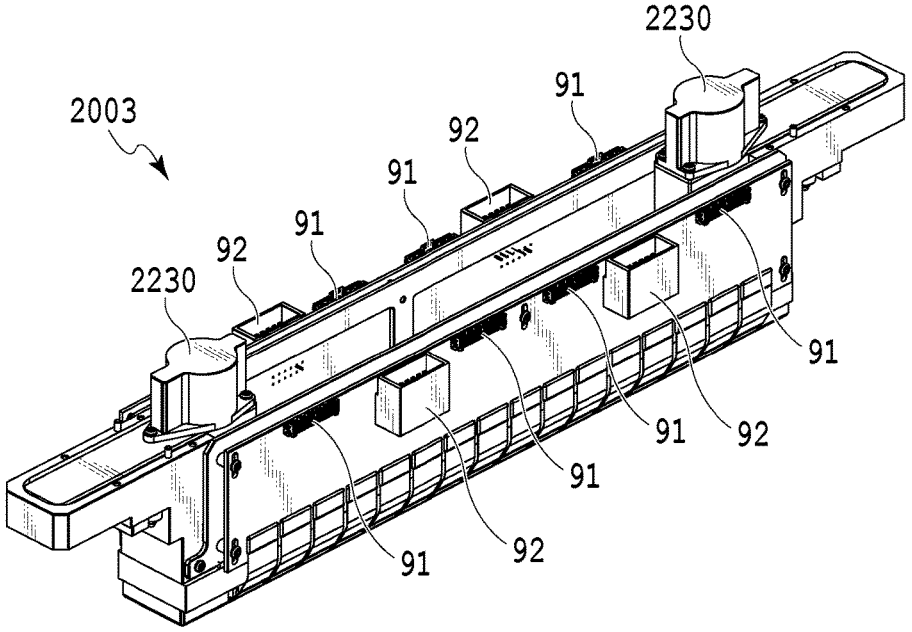

FIGS. 14A and 14B are perspective views illustrating the liquid ejection head 2003 according to the embodiment. Here, a structure of the liquid ejection head 2003 according to the embodiment will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first embodiment, the liquid ejection head 2003 includes the liquid connection portion 111, the signal input terminal 91, and the power supply terminal 92. However, since the liquid ejection head 2003 of the embodiment includes many ejection opening rows compared with the first embodiment, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
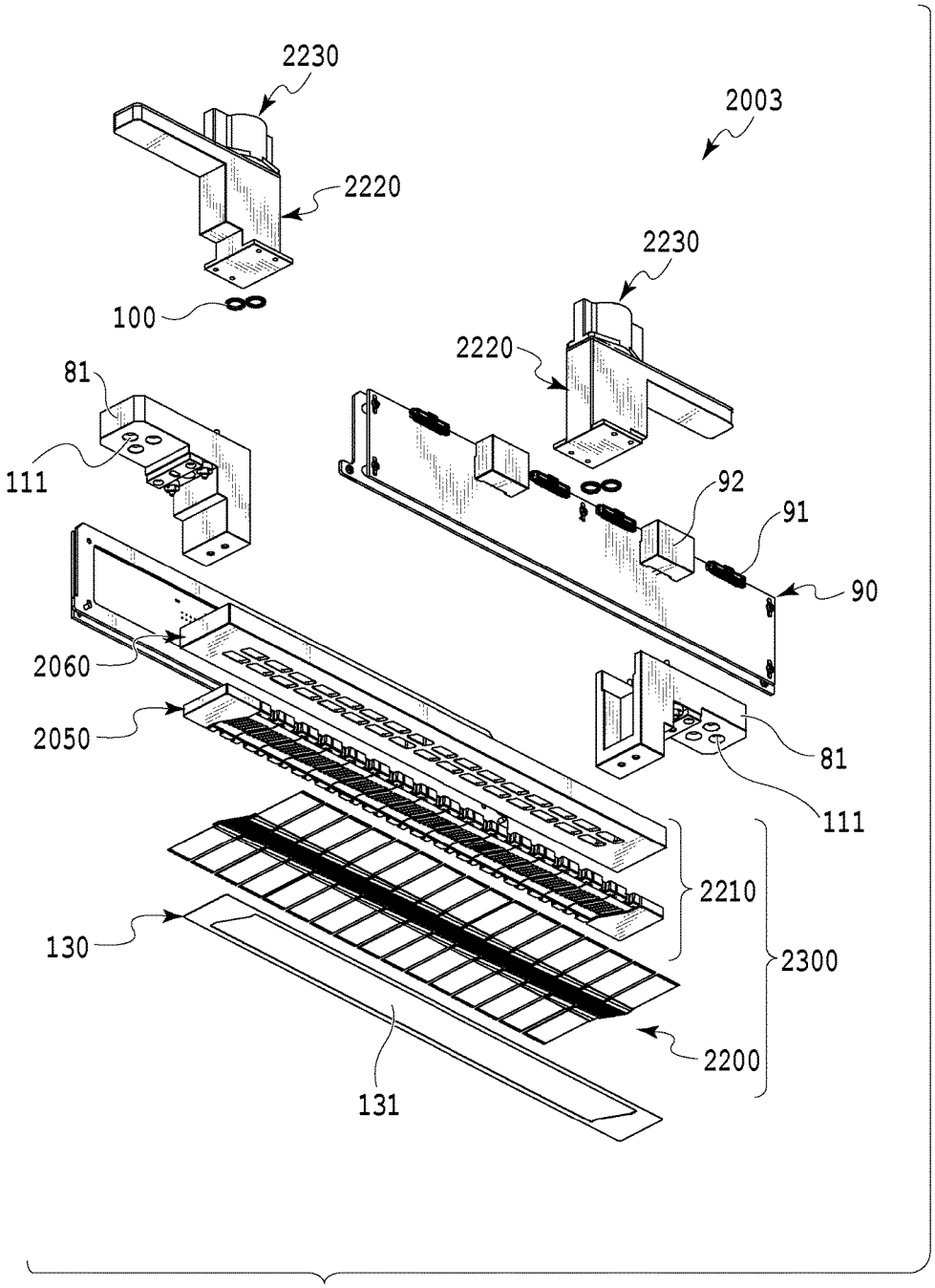
FIG. 15 is a perspective exploded view illustrating the liquid ejection head according to other example of the embodiment.

FIG. 15 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first embodiment, but the function of guaranteeing the rigidity of the liquid ejection head is different. In the first embodiment, the rigidity of the liquid ejection head is mainly guaranteed by the liquid ejection unit support portion 81, but in the liquid ejection head 2003 of the second embodiment, the rigidity of the liquid ejection head is guaranteed by a second passage member 2060 included in a liquid ejection unit 2300. The liquid ejection unit support portion 81 of the embodiment is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
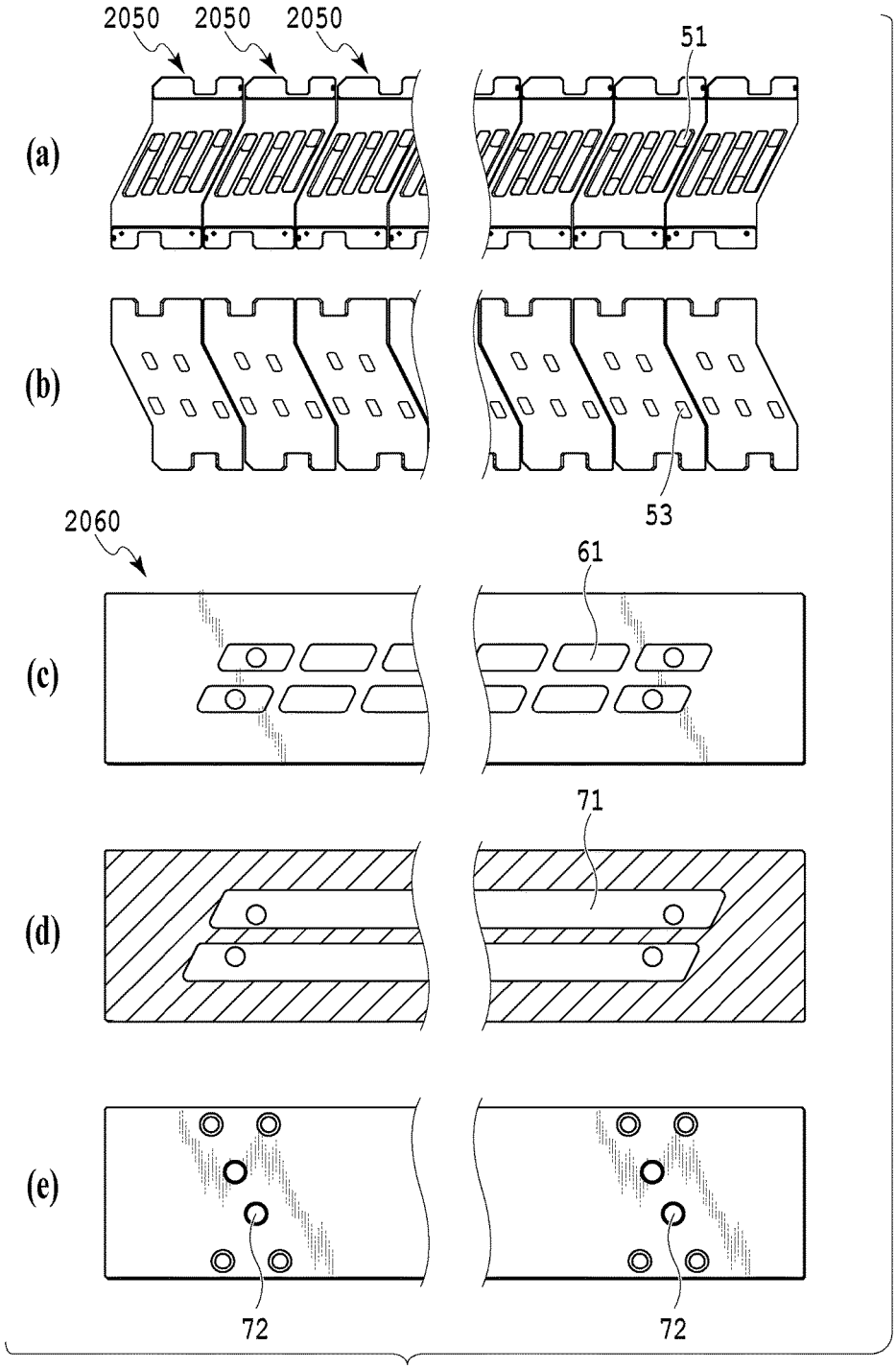
FIG. 16 is a diagram illustrating passage members making up the liquid ejection head according to other example of the embodiment.

FIG. 16-(*a*) is a diagram illustrating a face onto which the ejection module 2200 is mounted in the first passage member 2050 and FIG. 16-(*b*) is a diagram illustrating a rear face thereof and a face contacting the second passage member 2060. Differently from the first embodiment, the first passage member 2050 of the embodiment has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in FIG. 16-(*a*), the communication opening 51 of the first passage member 2050 fluid-communicates with the ejection module 2200. As illustrated in FIG. 16-(*b*), the individual communication opening 53 of the first passage member 2050 fluid-communicates with the communication opening 61 of the second passage member 2060. FIG. 16-(*c*) illustrates a contact face of the second passage member 60 with respect to the first passage member 2050, FIG. 16-(*d*) illustrates a cross-section of a center portion of the second passage member 60 in the thickness direction, and FIG. 16-(*e*) is a diagram illustrating a contact face of the second passage member 2060 with respect to the liquid supply unit 2220. The function of the communication opening or the passage of the second passage member 2060 is similar to each color of the first embodiment. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The embodiment is different from the first embodiment in that the liquid flow directions in the common supply passage 2211 and the common collection passage 2212 are opposite to each other.

Figure 17:
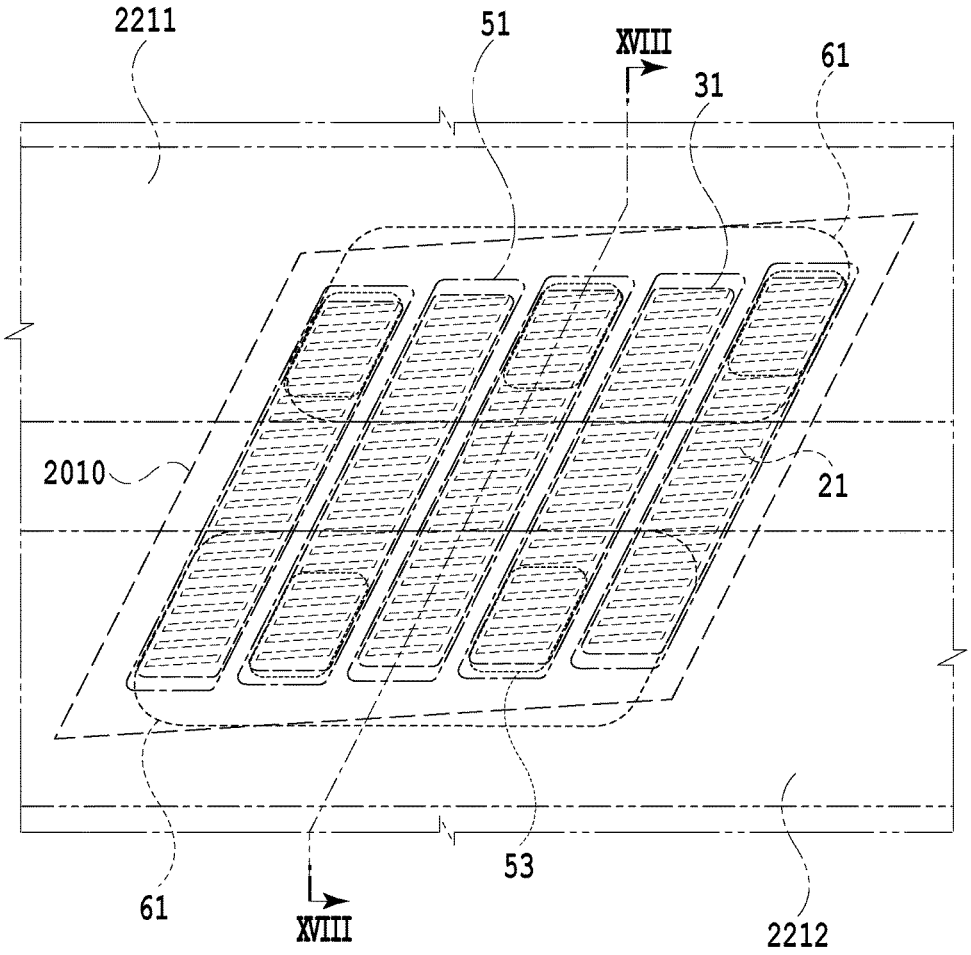
FIG. 17 is a transparent view illustrating a liquid connection relation between the print element board and the passage member in the liquid ejection head according to other example of the embodiment.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
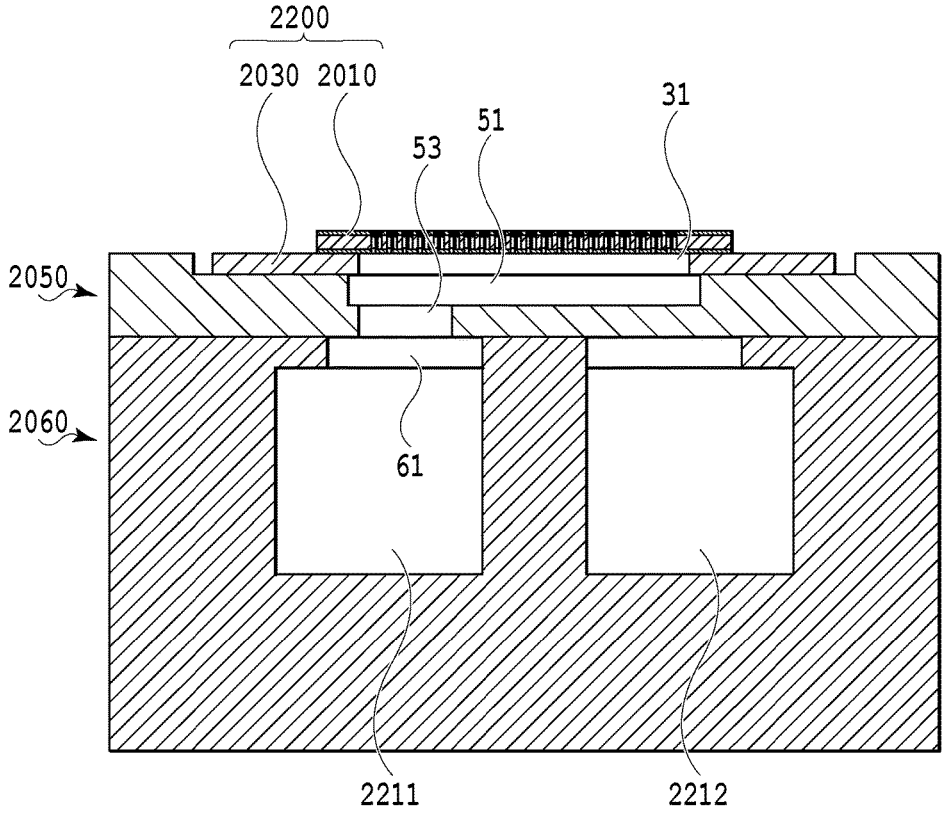
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first embodiment, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first embodiment, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 19A:
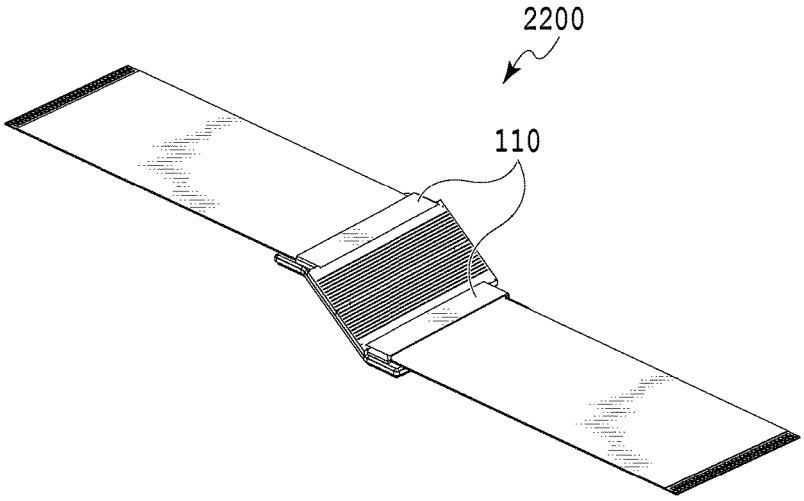
FIGS. 19A and 19B are a perspective view and an exploded view respectively illustrating ejection modules of the liquid ejection head according to other example of the embodiment.
Figure 19B:
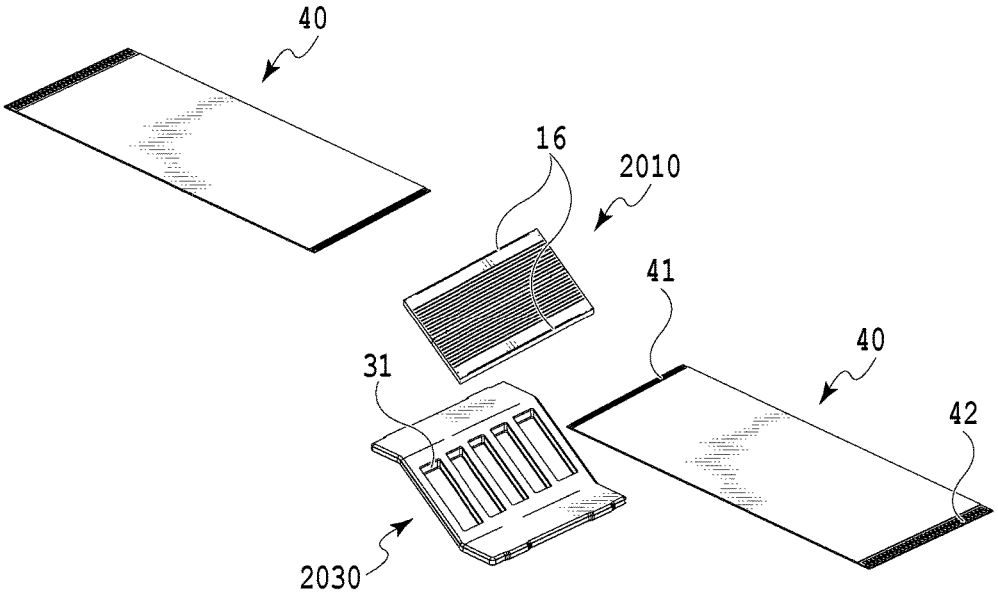

FIG. 19A is a perspective view illustrating one ejection module 2200 and FIG. 19B is an exploded view thereof. A difference from the first embodiment is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first embodiment. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first embodiment.

(Description of Structure of Print Element Board)

Figure 20:
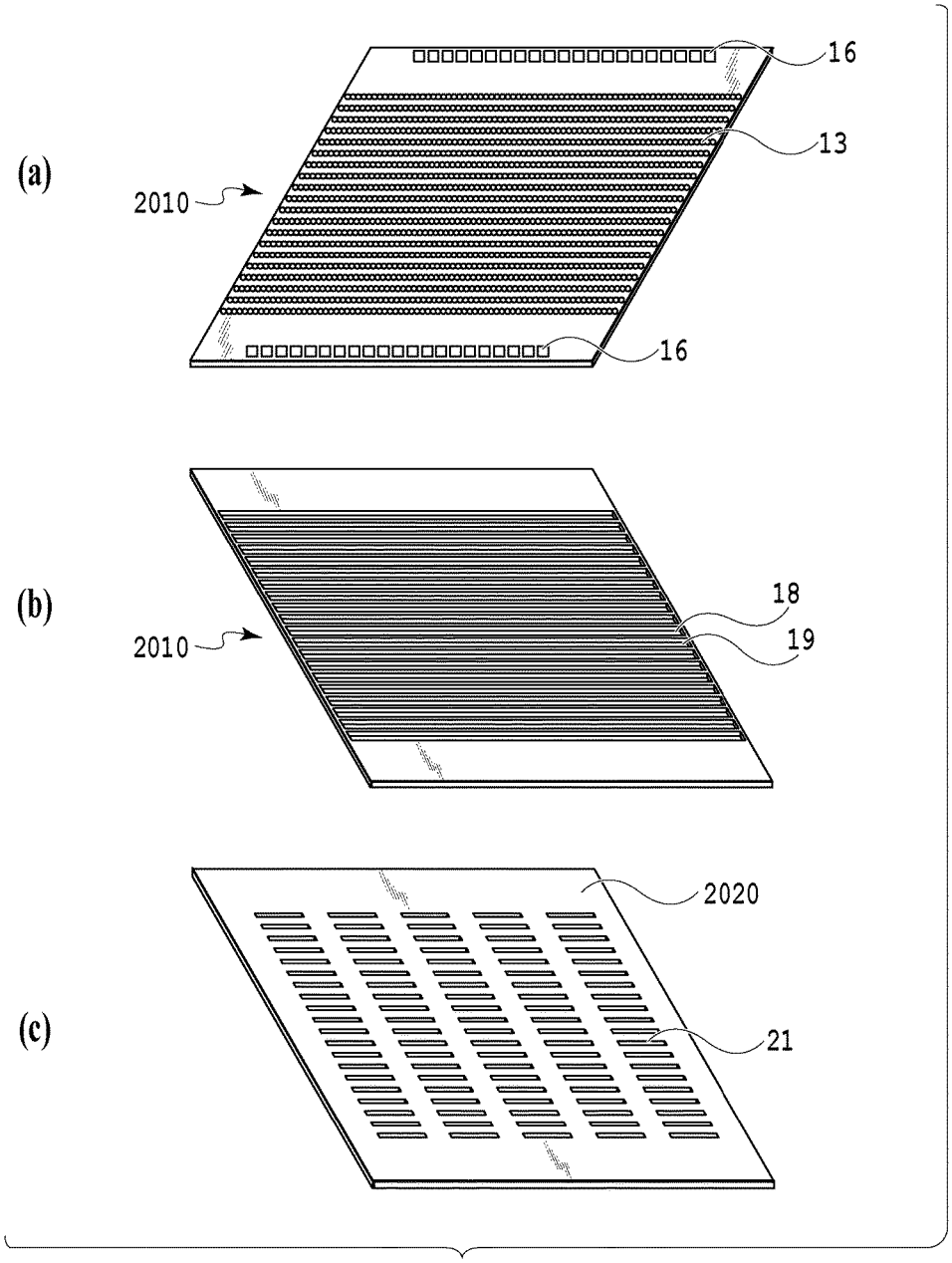
FIG. 20 is a schematic diagram illustrating a surface of the print element board on which ejection openings are arranged, a surface of the print element board in a condition that a cover plate is removed from an opposite side of the print element board, and an opposite side surface to the surface on which ejection openings are arranged.

FIG. 20-(*a*) is a schematic diagram illustrating a face on which the ejection opening 13 is disposed in the print element board 2010 and FIG. 20-(*c*) is a schematic diagram illustrating a rear face of the face of FIG. 20-(*a*). FIG. 20-(*b*) is a schematic diagram illustrating a face of the print element board 2010 when a cover plate 2020 provided in the rear face of the print element board 2010 in FIG. 20-(*c*) is removed. As illustrated in FIG. 20-(*b*), the liquid supply path 18 and the liquid collection path 19 are alternately provided along the ejection opening row direction at the rear face of the print element board 2010. The number of the ejection opening rows is larger than that of the first embodiment. However, a basic difference from the first embodiment is that the terminal 16 is disposed at both sides of the print element board in the ejection opening row direction as described above. A basic configuration is similar to the first embodiment in that a pair of the liquid supply path 18 and the liquid collection path 19 is provided in each ejection opening row and the cover plate 2020 is provided with the opening 21 communicating with the liquid communication opening 31 of the support member 2030.

The description of the above-described embodiment does not limit the scope of the invention. As an example, in the embodiment, a thermal type has been described in which bubbles are generated by a heating element to eject the liquid. However, the invention can be also applied to the liquid ejection head which employs a piezo type and the other various liquid ejection types.

In the embodiment, the inkjet printing apparatus (the printing apparatus) has been described in which the liquid such as ink is circulated between the tank and the liquid ejection head, but the other embodiments may be also used. In the other embodiments, for example, a configuration may be employed in which the ink is not circulated and two tanks are provided at the upstream side and the downstream side of the liquid ejection head so that the ink flows from one tank to the other tank.

In the embodiment, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a printing element board ejecting black ink and a printing element board ejecting color ink, but the invention is not limited thereto. That is, a liquid ejection head which is shorter than the width of the print medium and includes a plurality of printing element boards disposed so that the ejection openings overlap each other in the ejection opening array direction may be provided and the print medium may be scanned by the liquid ejection head.

Next, hereinafter, a description will be given of embodiments of the invention associated with configurations of the negative pressure control unit and the flow resistance adjustment mechanism in the liquid ejection heads of the first and second modes described above.

<Pressure Reducing-Type Negative Pressure Control Unit>

Figure 22A:
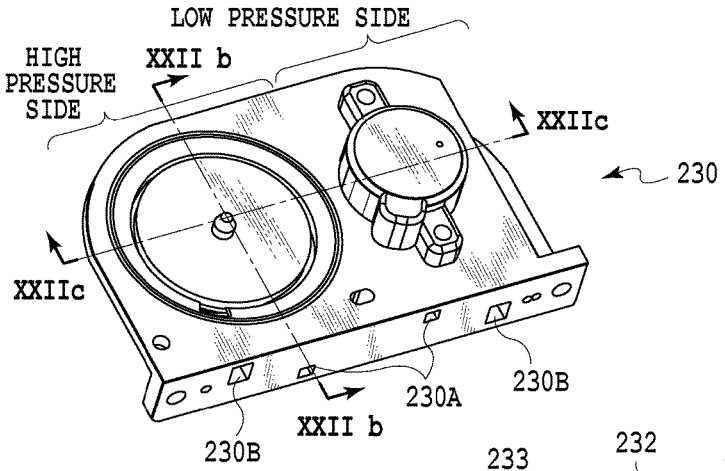
FIGS. 22A, 22B, and 22C are diagrams illustrating a specific configuration of a negative pressure control unit suitable to be used for the first circulation configuration illustrated in FIG. 2 according to an embodiment of the invention.
Figure 22B:
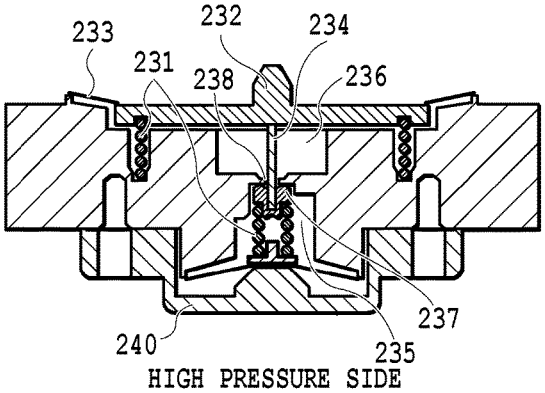
Figure 22C:
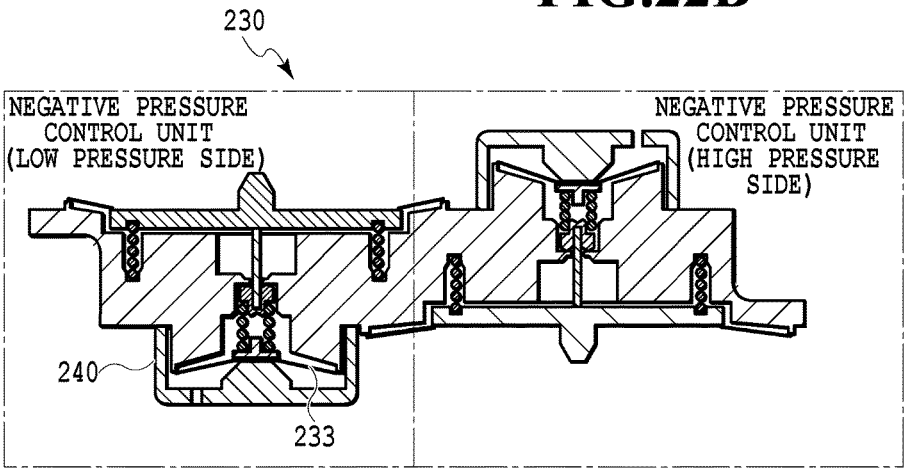

FIGS. 22A to 22C are diagrams illustrating a specific configuration of a negative pressure control unit 230 suitable to be used for the first circulation configuration illustrated in FIG. 2 according to an embodiment of the invention. The negative pressure control unit 230 is similar to a unit generally referred to as a "pressure reduction regulator", and is also referred to as a pressure reducing-type negative pressure control unit in the present specification. FIG. 22A illustrates an external appearance of the negative pressure control unit, and FIGS. 22B and 22C illustrate cross sections taking along XXIIB-XXIIB line and XXIIC-XXIIC line of FIG. 22A, respectively.

In the present embodiment, in the negative pressure control unit 230, a pair of negative pressure control mechanisms set to a higher pressure side (H) and a lower pressure side (L) is integrated with each other. In this case, as illustrated in FIG. 22C, the two negative pressure control mechanisms are disposed to fit to each other. Thereby, miniaturization of the negative pressure control unit 230 may be attempted. The two negative pressure control mechanisms set to the high pressure side and the low pressure side have the same basic configuration and the same operation principle, and are merely different from each other in urging force of an urging member 231 and dimensions of a pressure plate. For this reason, hereinafter, only the negative pressure adjustment mechanism at the high pressure side (H) will be described with reference to FIG. 22B.

A liquid flow will be described. A liquid from an outside flows in an inlet 230A (FIG. 22A) of the negative pressure control unit 230, and flows into a second pressure chamber 236 through a gap between a valve 237 and an opening portion 238. Then the liquid in the second pressure chamber 236 is supplied to the liquid ejection head 300 (see FIG. 2) through an outlet 230B. As illustrated in FIG. 22B, a pressure plate 232, a first pressure chamber 235, and a second pressure chamber 236 sealed by the pressure plate and a flexible film 233 are provided inside the negative pressure control unit 230. In addition, an opening portion 238 is provided through which the first pressure chamber 235 and the second pressure chamber are communicated with each other. A valve 237 mechanically connected to the pressure plate 232 by a shaft 234 is provided inside the first pressure chamber. The shaft 234, the valve 237, and the pressure plate 232 are configured to integrally move at the time of driving a head. In addition, the pressure plate 232 is urged in a direction in which the valve 237 is closed by an urging member (spring) 231. In the present specification, a pressure receiving portion refers to a portion obtained by combining the pressure plate 232 and the flexible film 233 together.

However, the whole flexible film 233 is not shifted based on a pressure inside the second pressure chamber. A film portion adjacent to the flexible film 233 mainly functions as the pressure receiving portion, and a portion of the flexible film 233 that is not shifted based on a pressure change exists. An effective range in which the film receives a pressure varies according to dimensions of each portion or the pressure.

The valve 237 may vary a gap between the opening portion 238 and the valve 237, thereby varying a flow resistance. In addition, when a first circulation pump is suspended, the valve 237 may touch, block, and fluidly seal the opening portion 238. When the valve 237 and the opening portion 238 are fluidly sealed, a negative pressure may be allowed to continue to act on an ejection opening at the time of suspending the circulation pump (that is, at the time of suspending the printing apparatus), and an ink leakage from the ejection opening may be prevented. An elastic material such as rubber, elastomer, etc. having sufficient corrosion resistance with respect to liquid is preferably used as a material of the valve 237.

In the present embodiment, the pressure receiving portion includes the pressure plate 232 and the flexible film 233. However, another configuration may be used when the configuration has a mechanism in which a position of the valve 237 may be varied according to a pressure inside the second pressure chamber. For example, a configuration in which the pressure plate 232 is not present, and the flexible film 233 is joined to the shaft 235 may be used, or a film-shaped member (diaphragm) having flexibility may be used in place of the pressure plate and the film and set as the pressure receiving portion. In this case, the diaphragm has a function as urging means that urges the valve in addition to a function as the pressure receiving portion.

In addition, in FIG. 22B, two coupled springs are provided as a spring corresponding to the urging member. However, there is no problem in a pressure adjustment function when an added spring force satisfies a desired negative pressure value. For this reason, a configuration in which only one spring is used or three or more springs are used may be used. Further, in the present embodiment, a coil spring is used as a mechanism that causes an urging force to act on the valve 237. However, another mechanism, for example, a flat spring may be used. In addition, it is possible to employ a configuration in which an urging force is applied to the valve 237 using a diaphragm corresponding to a film-shaped elastic body instead of the pressure plate and the flexible film as described above.

As illustrated in FIG. 22B, it is possible to employ a configuration in which one urging member in the two coupled springs is divided and provided inside the second pressure chamber 236, and the pressure plate 232 and the shaft 234 may be separated from each other. In addition, an urging force by the urging member inside the second pressure chamber acts on the pressure plate 232 even in a state in which the pressure plate 232 and the shaft 234 are separated from each other. For this reason, even in a state in which the valve 237 is blocked, the pressure plate 232 may be separated from the shaft 234 and shifted in a direction in which the volume inside the second pressure chamber is further increased by an action of the urging member inside the second pressure chamber 236. In this way, even when the liquid ejection head is not driven for a long period of time, and bubbles are captured inside the liquid ejection head, the second pressure chamber 236 may function as a buffer to absorb an increment in volume of the bubbles, thereby preventing the inside of the head from being a positive pressure.

In addition, in FIG. 22B, the valve 237 is provided at an upstream side of the opening portion 238. Further, when the pressure plate is shifted upward in FIG. 22B, the shift is delivered to the valve, and a gap between the opening portion 238 and the valve 237 is reduced. A liquid entering from an inlet 230A of the first pressure chamber 235 (FIG. 22A) flows into the second pressure chamber 236 by passing through the gap between the opening portion 238 and the valve 237, and delivers a pressure thereof to the pressure plate 232. Thereafter, the liquid is supplied to the liquid ejection unit 300 (see FIG. 2) from an outlet 230B of the second pressure chamber 236 (FIG. 22A).

A pressure P2 inside the second pressure chamber 236 is determined based on an expression below indicating a balance of forces applied to respective units.

$$P2=P0-(P1Sv+k1x)/Sd \qquad \text{Expression (1)}$$

Herein, Sd denotes a pressure receiving area of the pressure plate, Sv denotes a pressure receiving area of a valve portion, P0 denotes the atmospheric pressure, P1 denotes a pressure inside the first pressure chamber 235, P2 denotes a pressure inside the second pressure chamber 236, k1 denotes a spring constant of the urging member 231, and x denotes spring displacement.

P2 may be set to a desired control pressure by changing a force of the urging member 231. To change the force of the urging member, the spring constant k1 is changed or a spring length at the time of operation is changed.

In addition, when a flow resistance of a gap between the valve and the opening portion is set to R, and a flow amount of a liquid passing through the inside of the negative pressure control unit 230 is set to Q, an expression below is satisfied.

$$P2=P1-QR \qquad \text{Expression (2)}$$

Figure 23:
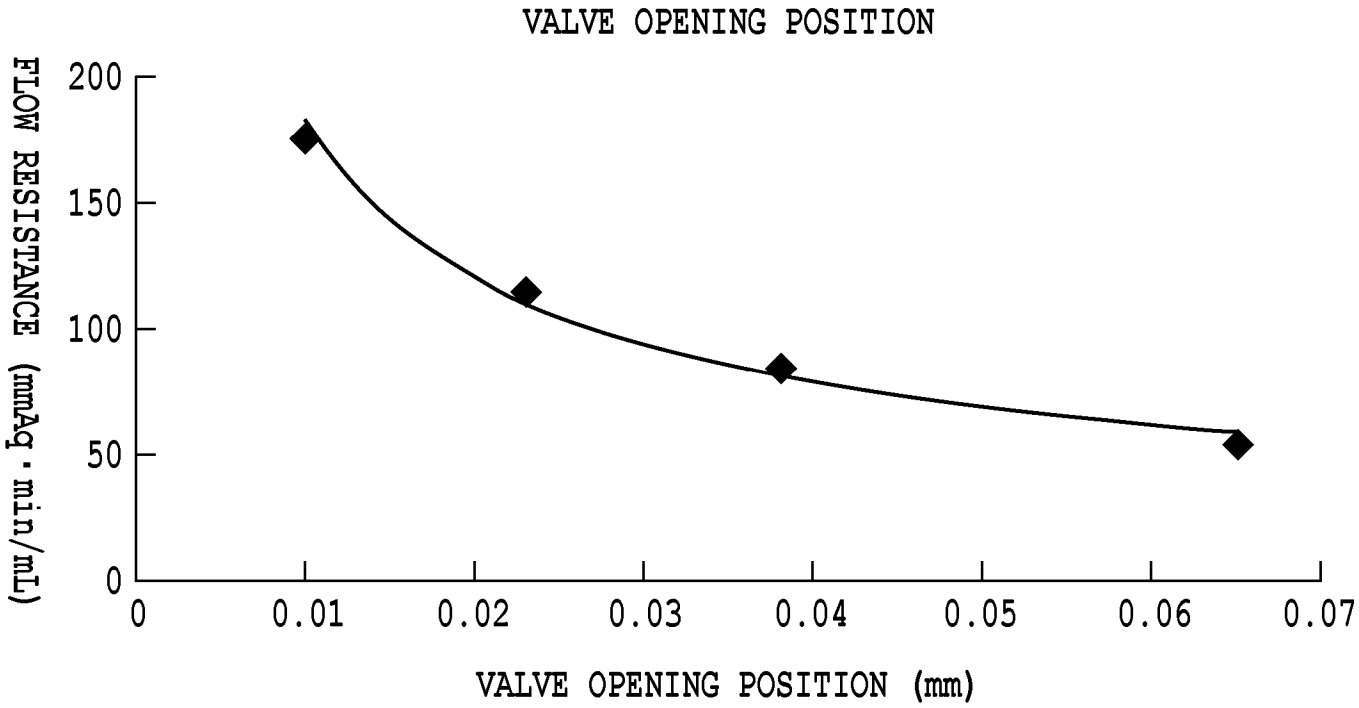
FIG. 23 is a diagram illustrating a relation between a flow resistance between a valve and an opening portion and a valve opening position, in the negative pressure control unit according to the embodiment.

Herein, for example, the flow resistance R and the gap between the valve and the opening portion (hereinafter referred to as a "valve opening position") are designed to have a relation illustrated in FIG. 23. FIG. 23 is a diagram illustrating a relation between a valve opening position and a flow resistance between the valve and the opening portion in the negative pressure control unit according to the present embodiment. As illustrated in FIG. 23, the flow resistance R decreases as the valve opening position increases. P2 is determined when the valve opening position is determined such that the above-described Expression (1) and Expression (2) are simultaneously satisfied.

In more detail, when an amount Q of a flow flowing into the negative pressure control unit 230 increases, P1 decreases by an increment of a flow resistance between the second circulation pump and the negative pressure control unit 230 resulting from the increase in flow amount since a pressure in the second circulation pump (liquid feed pump) 1004 (see FIG. 2) connected to an upstream of the negative pressure control unit is constant. For this reason, a force P1Sv of blocking the valve decreases, and P2 instantaneously increases due to Expression (1).

In addition, R=(P1−P2)/Q is calculated from Expression (2). Herein, since Q and P2 increase, and P1 decreases, R decreases. When R decreases, the valve opening position increases due to the relation illustrated in FIG. 23. As can be understood from FIG. 22B, when the valve opening position increases, a length of the urging member (spring 231) decreases, and thus x corresponding to displacement from a free length increases. For this reason, a force k1x of the spring increases. As a result, P2 instantaneously decreases from Expression (1). Inversely, when the flow amount Q decreases, and P2 instantaneously increases, P2 instantaneously decreases due to a reverse action of the above description. When this phenomenon is instantaneously repeated, both Expression (1) and Expression (2) are satisfied while the valve opening position changes depending on the flow amount Q. Thus, P2 is controlled at a constant value. As a result, a pressure at a downstream of the negative pressure control unit 230 (that is, an inlet of the liquid ejection unit) is autonomously controlled at a constant value.

In addition, as can be understood from Expression (1), since a fluctuation range of P2 equals a fluctuation range x (Sv/Sd) of P1, when the ratio of Sv/Sd is designed to be sufficiently small, the fluctuation range of P2 may be set to be sufficiently small even when P1 slightly varies due to a pulse, etc. of the second circulation pump 1004 (FIG. 2). For this reason, a pressure sensor, negative pressure adjustment power, etc. are unnecessary, and a main body of the liquid ejection apparatus may be simplified.

<Back Pressure-Type Negative Pressure Control Unit>

Figure 24A:
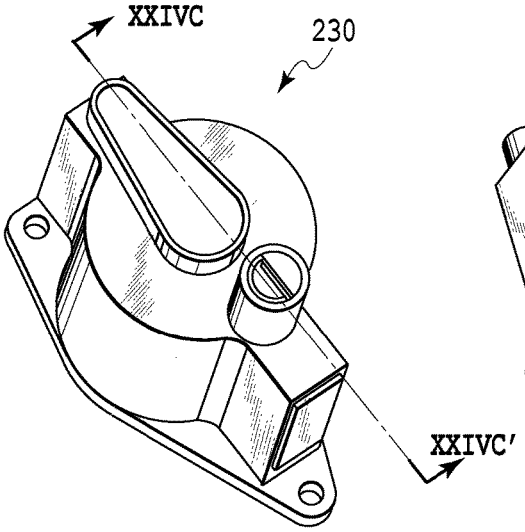
FIGS. 24A, 24B, and 24C are diagrams illustrating a specific configuration of a negative pressure control unit suitable to be used for the second circulation configuration illustrated in FIG. 3 according to an embodiment of the invention.
Figure 24B:
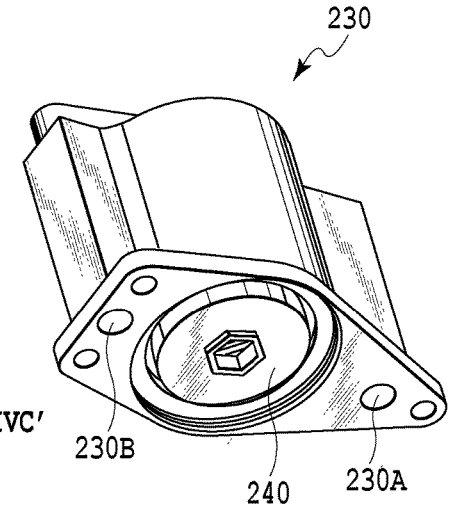
Figure 24C:
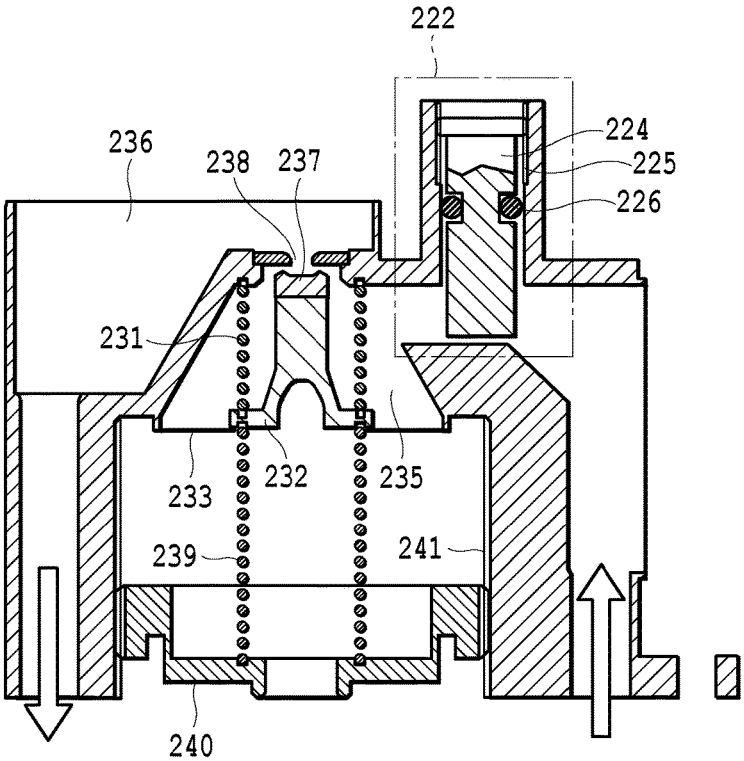

FIGS. 24A to 24C are diagrams illustrating a specific configuration of a negative pressure control unit 230 suitable to be used for the second circulation configuration illustrated in FIG. 3 according to an embodiment of the invention. The negative pressure control unit 230 is similar to a unit generally referred to as a "back pressure regulator", and is also referred to as a back pressure-type negative pressure control unit in the present specification. FIGS. 24A and 24B illustrate external appearances of negative pressure control units of the present embodiment at a high pressure side (H) and a low pressure side (L), respectively, and FIG. 24C illustrates a cross section taking along XXIVC-XXIVC line of FIG. 24A.

Unlike the pressure reducing-type pressure adjustment mechanism illustrated in FIGS. 22A to 22C, two negative pressure control units at the high pressure side (H) and the low pressure side (L) are configured as individual bodies in the present embodiment. Further, one negative pressure control unit 230 is disposed at each of both ends of the liquid ejection unit 300 as illustrated in FIGS. 14A and 14B. This embodiment in which the negative pressure control units are configured as the individual bodies is an example, and the high pressure side and the low pressure side may be integrally formed as in the pressure reducing-type negative pressure control unit illustrated in FIGS. 22A to 22C. FIG. 3 according to the present embodiment illustrates the integrally formed negative pressure control unit. The two negative pressure adjustment mechanisms set as the high pressure side and the low pressure side have the same basic configuration and the same operation principle, and are merely different from each other in urging force acting on the valve or pressure receiving area of the pressure plate.

The pressure receiving portion, a pressure receiving portion which is not described below, and an urging mechanism are the same as those of the pressure reducing-type negative pressure control unit described above with reference to FIGS. 22A to 22C.

As illustrated in FIG. 24C, differences from a pressure reducing valve-type negative pressure control unit are that a valve 237 is disposed inside a first pressure chamber 235, a gap between an opening portion 238 and the valve 237 is enlarged when a pressure plate 232 moves downward in FIG. 24C, a liquid flow inside the negative pressure control unit 230 is reversed, and a side at which the pressure plate is disposed corresponds to the first pressure chamber at an upstream. A liquid flow will be described. A liquid from the liquid ejection head 300 flows into the first pressure chamber 235 through the inlet 230A of the negative pressure control unit 230, and flows into the second pressure chamber 236 through the gap between a valve 237 and an opening portion 238. Then the liquid in the second pressure chamber 236 is supplied to an outside through the outlet 230B.

A pressure adjustment mechanism may be described as nearly the same mechanism as that of the above-described pressure reducing-type pressure adjustment mechanism. In more detail, a pressure P1 inside the first pressure chamber 235 is determined from Expression (3) below indicating a balance of forces acting on respective units. Unlike the pressure reducing-type negative pressure control unit, a second urging member 239 is disposed on an opposite side from the first pressure chamber 235 with respect to the pressure plate 232 in the back pressure-type negative pressure control unit of the present embodiment. For this reason, when spring constants of an urging member 231 and the second urging member 239 are set to k1 and k2, and displacements thereof at a valve opening position of zero are set to x0 and y0, respectively, displacement of the first urging member from a free length decreases by a, and displacement of the second urging member increases by a when the opening degree a increases. In this way, an expression below is derived from the balance relation of the forces acting on the respective units.

$$P1Sd+k1(x0-a)+P2Sv=P0Sd+k2(y0+a)$$

An expression below is obtained by transforming the above expression.

$$P1=P0-(P2Sv/Sd)+(k1+k2)a/Sd-PL \qquad \text{Expression (3)}$$

Herein, Sd denotes a pressure receiving area of the pressure plate, Sv denotes a pressure receiving area of a valve portion, P0 denotes the atmospheric pressure, P1 denotes a pressure inside the first pressure chamber, P2 denotes a pressure inside the second pressure chamber, k1 denotes a spring constant of the urging member 231, k2 denotes a spring constant of the second urging member 239, "a" denotes a valve opening position, x0 denotes displacement of the first urging member from a free length at the valve opening position of zero, y0 denotes displacement of the second urging member from a free length at the valve opening position of zero, and PL (Preload)=(k1x0−k2y0)/Sd.

In addition, Expression (2) described above with regard to the pressure reducing-type negative pressure control unit is similarly satisfied in the back pressure-type negative pressure control unit of the present embodiment. Herein, a relation between the valve opening position and the flow resistance R of the gap portion between the valve and the opening portion is designed to correspond to the relation illustrated in FIG. 23. In other words, the flow resistance R decreases as the valve opening position increases. In the present embodiment, P1 is determined by setting the valve opening position such that Expression (3) and Expression (2) are simultaneously satisfied.

When an amount Q of a flow flowing out of the negative pressure control unit 230 increases, P2 increases by an increment of a flow resistance between the second circulation pump and the negative pressure control unit 230 resulting from the increase in flow amount since a pressure in the second circulation pump 1004 (see FIG. 3) connected to a downstream of the negative pressure control unit is constant. For this reason, a force P2Sv of opening the valve increases, and P1 instantaneously decreases due to Expression (3). In addition, R=(P1−P2)/Q is derived from Expression (2).

Herein, since Q and P2 increase, and P1 decreases, R decreases. In addition, when R decreases, the valve opening position increases due to the relation illustrated in FIG. 23. As illustrated in FIG. 24C, when the opening degree of the valve 237 increases, lengths of the urging member 231 and the second urging member 239 increases and decreases, respectively. Thus, displacement from free lengths thereof decreases and increases. As a result, a valve force of the first urging member and a valve force of the second urging member decreases and increases, respectively. Accordingly, a force in a direction in which the valve is opened decreases as the valve opening position increases. For this reason, P1 instantaneously increases due to Expression (3). Inversely, when the flow amount Q decreases, and P1 instantaneously increases, P1 instantaneously decreases due to a reverse action of the above description.

When this phenomenon is instantaneously repeated, both Expression (3) and Expression (2) are satisfied while the valve opening position changes depending on the flow amount Q. As a result, P1 is controlled at a constant value. Thus, a pressure at an upstream of the negative pressure control unit 230 (that is, an outlet of the liquid ejection unit) is autonomously controlled at a constant value. In addition, as easily understood from Expression (3), since a fluctuation range of P1 equals a fluctuation range x (Sv/Sd) of P2, when the ratio of Sv/Sd is designed to be sufficiently small, the fluctuation range of P1 may be set to be sufficiently small even when P2 slightly varies due to a pulse, etc. of the second circulation pump. For this reason, a pressure sensor, negative pressure adjustment power, etc. are unnecessary, and a main body of the printing apparatus may be simplified.

<Negative Pressure Control Unit of Another Embodiment>

Figure 25:
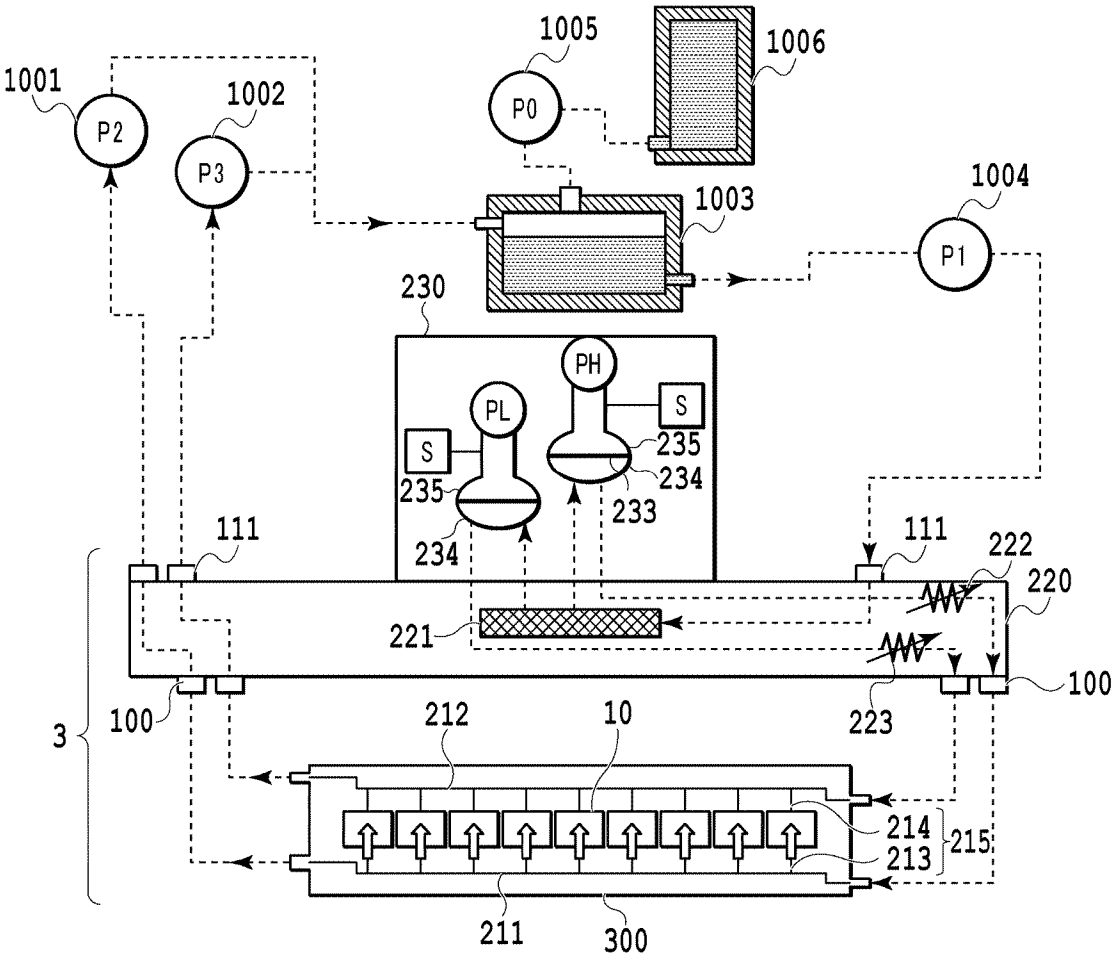
FIG. 25 is a diagram illustrating another embodiment of the negative pressure control unit suitable to be used in the first circulation configuration illustrated in FIG. 2.

FIG. 25 is a diagram illustrating another embodiment of the negative pressure control unit suitable to be used in the first circulation configuration illustrated in FIG. 2. As illustrated in FIG. 25, two negative pressure adjustment mechanisms, each of which has an inside partitioned into a liquid chamber 234 and an air chamber 235 by a flexible film 233, are incorporated in the negative pressure control unit 230. A pressure sensor S and air pumps PH and PL are connected to each air chamber 235. Although not illustrated in FIG. 25, each of the pressure sensor S and the air pumps PH and PL is electrically connected to a controller of the main body of the apparatus. The controller controls driving of the air pumps PH and PL as a high pressure side and a low pressure side, respectively, based on a pressure value from the pressure sensor S and a set pressure value stored in the controller. This control allows a pressure in each liquid chamber 234 to be maintained at a desired pressure, and a desired differential pressure to be generated between a common supply passage 211 and a common collection passage 212.

In addition, similarly to the case of the negative pressure control unit illustrated in FIG. 2, a shift in flow resistance may be corrected by operations of a supply-side flow resistance adjustment mechanism 222 and a collection-side flow resistance adjustment mechanism 223 in the negative pressure control unit illustrated in FIG. 25. In other words, even when a flow resistance is shifted from a set value in the common supply passage 211 or the common collection passage 212, a desired pressure may be allowed to act at a desired flow amount at an inlet of the common passage by correcting a shift in flow resistance between the negative pressure control unit and the common passage. As a result, it is possible to reduce a tolerance between a set value and a differential pressure between the common supply passage and the common collection passage, and to reduce a variation of the amount of a circulation flow flowing in each liquid ejection head.

(Adjustment of Pressure Tolerance of Pressure Varying-Type (Pressure Reducing-Type) Negative Pressure Control Unit)

An embodiment of the invention is to correct a tolerance of a control pressure by the pressure reducing-type negative pressure control unit described above with reference to FIGS. 22A to 22C. As described in the foregoing, since the negative pressure control unit corresponds to the same mechanism as that of a pressure reducing-type pressure adjustment value having a force balance type, in general, a negative gradient (a control pressure decreases as so-called droop, the flow amount increases) is present in the control pressure/the flow amount, and a tolerance may be generated in the gradient. In the present embodiment, the gradient of the control pressure/the flow amount is set to be positive, the gradient is adjusted by adjusting a flow resistance in a flow resistance adjustment mechanism, and a change in pressure associated with a change in flow amount at an inlet of a common passage is suppressed.

In addition, in a general pressure reducing-type pressure adjustment valve, a tolerance is generated in a control pressure value at a certain flow amount due to a tolerance of an area of a pressure plate or a spring force. The present embodiment simultaneously corrects the tolerance of the control pressure and the tolerance of the gradient of the control pressure/the flow amount.

In description below, the negative pressure adjustment mechanism at the high pressure side illustrated in FIG. 22B will be described. However, the negative pressure adjustment mechanism at the low pressure side is similar, and thus a description thereof will be omitted. In FIG. 22B, a negative pressure adjustment member 240 has an outside air communication opening, and is fixed to a main body of the negative pressure control unit. A mechanical method or a method using an adhesive may be preferably used as a fixing method.

Herein, a spring constant of the urging member 231 is set to k1, and displacement at a valve opening position of zero is set to x0 and y0, respectively. When an opening degree "a" increases, displacement of the urging member 231 from a free length increases by "a". Thus, an expression below is derived from a relation of a balance of forces applied to respective units.

$$P2Sd+k1(x0+a)+P1Sv=P0Sd$$

An expression below is obtained by transforming the above expression.

$$P2=P0-(P1Sv/Sd)-k1a/Sd-PL \quad \text{Expression (4)}$$

Herein, "a" denotes a valve opening position, x0 denotes displacement of the urging member 231 from a free length at an opening degree of zero, and PL (Preload)=(k1x0)/Sd.

<Adjustment of Tolerance of P2>

As illustrated in FIG. 22C, the negative pressure adjustment member 240 comes into contact with the urging member on the first pressure chamber side through the flexible film 233. Herein, when a shape such as a thickness, a height, etc. of the negative pressure adjustment member is changed, displacement of the urging member may be changed, and the control pressure P2 may be adjusted. Specifically, when the shape of the negative pressure adjustment member 240 is changed to shorten a length of the urging member on the first pressure chamber side, x0 in the above expression increases, and thus PL of Expression (4) decreases, and P2 increases. On the other hand, when the length of the urging member on the first pressure chamber side is increased, x0 decreases, and thus PL of Expression (4) increases, and P2 decreases. In this way, the tolerance of the control pressure P2 may be corrected to perform an adjustment such that a desired control pressure P2 is obtained at a desired flow amount.

When both sides of Expression (4) are differentiated by the flow amount Q, an expression below is obtained.

$$dP2/dQ=-(Sv/Sd)dP1/dQ-k1/Sd\cdot da/dQ \quad \text{Expression (5)}$$

Herein, when the flow amount Q increases, pressure loss between the second circulation pump and the negative pressure control unit in FIG. 2 increases, thus P1 decreases. For this reason, dP1/dQ is negative. Meanwhile, the opening degree "a" increases as the flow amount Q increases. Thus, da/dQ is positive. Herein, when a design is performed such that Expression (6) below is satisfied, a gradient of the control pressure P2/the flow amount Q of the negative pressure control unit is positive as can be understood from Expression (5). In other words, the control pressure P2 rises as the flow amount Q increases. In this instant, a flow amount change rate R2 of a valve action pressure P1 satisfies the following expression.

$$R2>k1/Sv\cdot da/dQ(R2:-dP1/dQ) \quad \text{Expression (6)}$$

The negative pressure adjustment mechanism illustrated in FIGS. 22A to 22C which allows the above correction is used for the negative pressure control unit 230 illustrated in FIG. 2. In this case, a change in the positive gradient of P2/Q may be canceled out when the flow resistance is increased by adjusting the supply-side flow resistance adjustment mechanism 222 and the collection-side flow resistance adjustment mechanism 223 at a downstream of the negative pressure control unit 230. In this way, even when a tolerance is generated in the gradient of P2/Q, the tolerance may be corrected by an adjustment in the supply-side flow resistance adjustment mechanism 222 or the collection-side flow resistance adjustment mechanism 223.

As a specific adjustment method, for example, processes below may be performed.

1) A pressure at the inlet of the common supply passage and/or the common collection passage is measured at a minimum amount of a flow passing through the negative pressure control unit presumed in a specification of the liquid ejection apparatus.

2) Similarly, a pressure at the inlet of the common supply passage and/or the common collection passage is measured at a maximum amount of a flow passing through the negative pressure control unit presumed in the specification.

3) A pressure is adjusted by the negative pressure adjustment member 240 to approach the pressure measured in the above process 1) in the supply-side flow resistance adjustment mechanism 222 and the collection-side flow resistance adjustment mechanism 223 at the downstream of the negative pressure control unit 230 while the flow amount in the above process 2) is maintained.

Any one of a process of adjusting an absolute value of the control pressure P2 by an adjustment of the negative pressure adjustment member 240, and a process of adjusting the gradient P2/Q in the above processes 1) to 3) may be performed first. In general, resolving power of the pressure sensor used at the time of the adjustment is higher as a measurement range full scale is smaller, and is lower as the scale is larger. When this point is taken into consideration, first, a tolerance of the gradient P2/Q is corrected at high resolving power by performing the adjustment process in the above processes 1) to 3) using a high-accuracy pressure sensor which has a small measurement pressure range around the atmospheric pressure. In addition, thereafter, high-accuracy adjustment may be performed when the control pressure P2 is adjusted to around a desired pressure value by the negative pressure adjustment member 240 using a pressure sensor having a large measurement pressure range and a low-resolving power, and a tolerance of P2 is adjusted at the same time.

Figure 26:
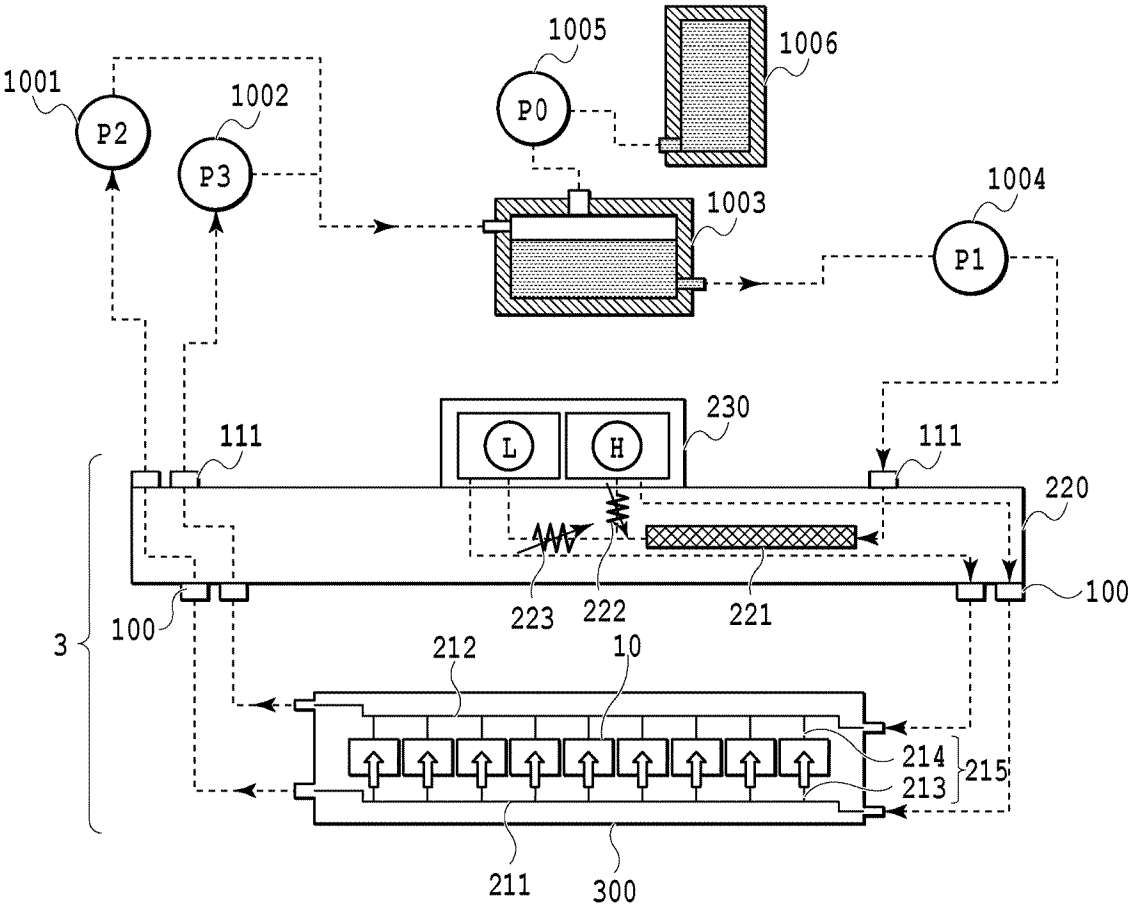
FIG. 26 is a schematic diagram illustrating a circulation path using a negative pressure control unit according to another embodiment.

As easily understood from Expression (6), the gradient P2/Q may be adjusted by adjusting R2. Specifically, as illustrated in FIG. 26, R2 may be adjusted by disposing flow resistance adjustment mechanisms 222 and 223 between a negative pressure control unit and a second circulation pump 1004. In an example illustrated in FIG. 26, the flow resistance adjustment mechanisms are incorporated in a liquid supply unit 220 included in a liquid ejection head. However, the same effect may be obtained when the flow resistance adjustment mechanisms are disposed outside the liquid ejection head. In addition, a pressure source capable of controlling a pressure (for example, a water head tank, a case including a flexible wall and an air pump, etc.) may be used instead of the second circulation pump.

(Adjustment of Pressure Tolerance of Pressure Varying-Type (Back Pressure-Type) Negative Pressure Control Unit)

An embodiment of the invention is to correct a tolerance of a control pressure by the back pressure-type negative pressure control unit described above with reference to FIGS. 24A to 24C. As described in the foregoing, since the negative pressure control unit corresponds to the same mechanism as that of a back pressure-type pressure adjustment value having a force balance type, in general, a positive gradient (a control pressure increases as so-called droop, the flow amount increases) is present in the control pressure/the flow amount, and a tolerance may be generated in the gradient. In the present embodiment, the gradient of the control pressure/the flow amount is set to be negative, the gradient is adjusted by adjusting a flow resistance in a flow resistance adjustment mechanism, and a change in pressure associated with a change in flow amount at an inlet of a common passage is suppressed.

In addition, in a general back pressure-type pressure adjustment valve, a tolerance is generated in a control pressure value at a certain flow amount due to a tolerance of an area of a pressure plate or a spring force. The present embodiment simultaneously corrects the tolerance of the control pressure and the tolerance of the gradient of the control pressure/the flow amount.

An adjustment of a pressure tolerance of the present embodiment will be described with reference to FIG. 24C.

A negative pressure adjustment mechanism of the present embodiment is basically the same as that illustrated in FIGS. 22A to 22C, and is different therefrom in that a second urging member, one end of which is fixed and supported by a negative pressure adjustment member 240, comes into contact with a surface of the pressure plate 232 on an opposite side from a first pressure chamber 235 as illustrated in FIG. 24C. The negative pressure adjustment member 240 has an outside air communication opening, and is configured to be movable inside a movable mechanism 241 of the negative pressure control unit. In the present embodiment, a male screw is formed on a side surface of the negative pressure adjustment member 240, and a female screw is formed in the movable mechanism 241. Further, a position of the negative pressure adjustment member 240 may be changed when the screws are engaged with each other.

<Adjustment of Tolerance of P1>

In FIG. 24C, y0 of a second urging member 239 is changed by moving the negative pressure adjustment member 240 in a vertical direction. In this way, the control pressure P1 may be adjusted. When the negative pressure adjustment member 240 is moved to approach a valve 237, y0 increases, and thus, PL of Expression (3) decreases, and P1 increases. Inversely, when the negative pressure adjustment member 240 is moved to become more distant from the valve 237, y0 decreases, and thus PL increases, and P1 decreases. In this way, the tolerance of the control pressure P1 may be corrected to obtain a desired control pressure P1 at a desired flow amount.

A position of the negative pressure adjustment member 240 of the present embodiment is adjusted by a screw-shaped member. Thus, when the printing apparatus is used over a long period of time after adjusting the tolerance of P1, there is concern that a relative position of the negative pressure adjustment member 240 and the valve 237 may change due to an influence of vibrations, etc. For this reason, it is more preferable to have a mechanism that fixes the negative pressure adjustment member 240 to the negative pressure control unit after the adjustment. Specifically, a caulking structure that prevents rotation of the negative pressure adjustment member 240, or a fixing method using an adhesive, etc. is preferably used.

In the present embodiment, an expression below similar to the above-described Expression (5) is obtained through differentiation with respect to the flow amount Q.

$$dP1/dQ=-(Sv/Sd)dP2/dQ+(k1+k2)/Sdda/dQ \qquad \text{Expression (7)}$$

When the flow amount Q increases, pressure loss between the negative pressure adjustment mechanism and a second circulation pump increases as can be understood from FIG. 3, and thus P2 increases. For this reason, dP2/dQ is positive. Meanwhile, since the opening degree "a" increases as the flow amount Q increases, da/dQ is positive. Herein, when a design is performed such that Expression (8) below is satisfied, a gradient of the control pressure P2/the flow amount Q of the negative pressure adjustment mechanism becomes negative as can be understood from Expression (7). In other words, the control pressure P1 decreases as the flow amount Q increases. In this instant, a flow amount change rate R3 of a valve action pressure P2 satisfies the following expression.

$$R3>(k1+k2)/Sv\cdot(da/dQ)(R3:dP2/dQ) \qquad \text{Expression (8)}$$

<Adjustment of Gradient P1/Q>

When the negative pressure adjustment mechanism having the above-described characteristic is applied to the back pressure-type negative pressure control unit of FIG. 3, a flow resistance may be adjusted by a supply-side flow resistance adjustment mechanism 222 and a collection-side flow resistance adjustment mechanism 223 at a downstream of the negative pressure control unit 230, and thus a negative gradient of P1/Q may be changed. In this way, even when a tolerance is generated in the gradient P1/Q, the tolerance may be corrected by an adjustment in the supply-side flow resistance adjustment mechanism 222 or the collection-side flow resistance adjustment mechanism 223.

As a specific adjustment method, for example, processes below may be performed.

1) A pressure at an inlet of a common supply passage and/or a common collection passage is measured at a minimum amount of a flow passing through the negative pressure control unit presumed in a specification of the liquid ejection apparatus.

2) Similarly, a pressure at the inlet of the common supply passage and/or the common collection passage is measured at a maximum amount of a flow passing through the negative pressure control unit presumed in the specification of the apparatus.

3) A pressure is adjusted to approach the pressure obtained in the above process 1) by an adjustment in the supply-side flow resistance adjustment mechanism 222 and the collection-side flow resistance adjustment mechanism 223 while the flow amount in the above process 2) is maintained.

An order of a process of adjusting an absolute value of the control pressure P1 by the negative pressure adjustment member 240, and a process of adjusting the gradient P1/Q in the above processes 1) to 3) is similar to that in the embodiment of the pressure reducing-type negative pressure control unit.

Figure 27:
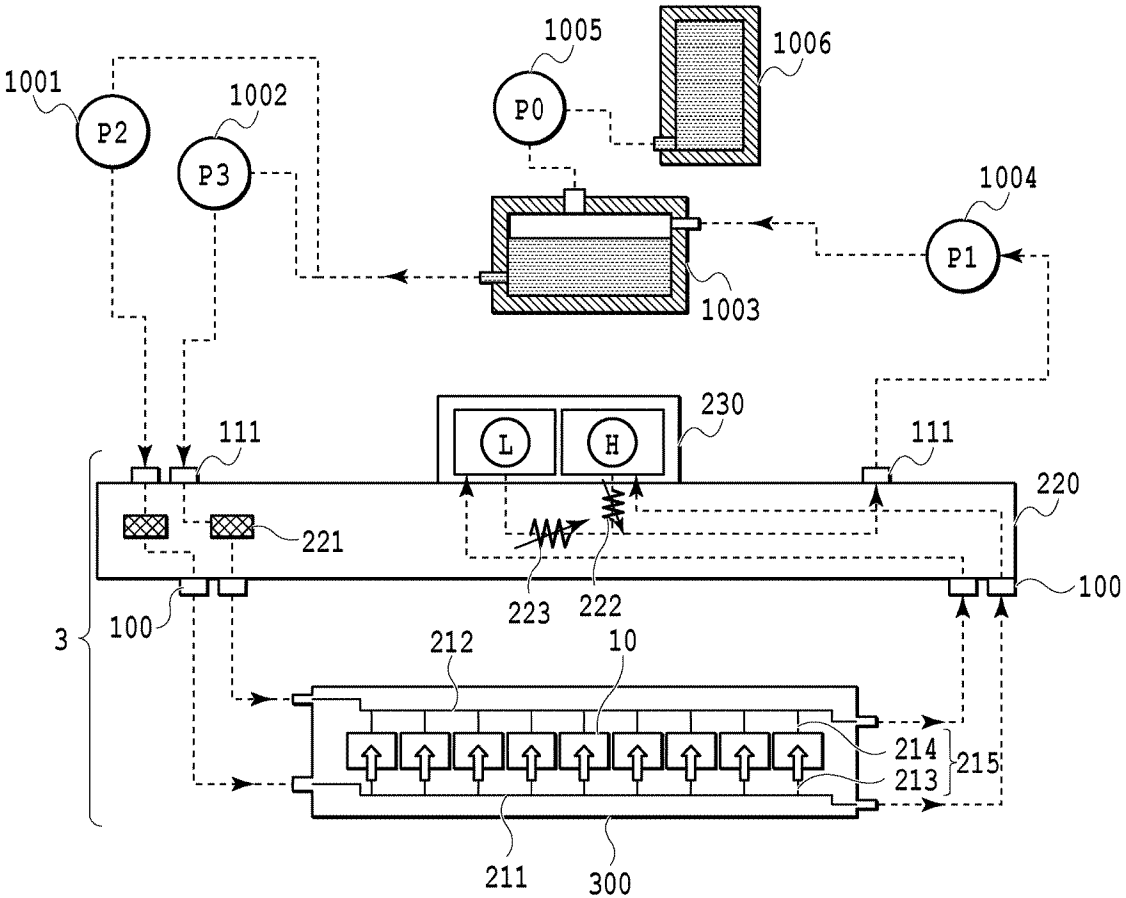
FIG. 27 is a schematic diagram illustrating a circulation path using a negative pressure control unit according to another embodiment.

As easily understood from Expression (8), the gradient P1/Q may be adjusted by adjusting R3. Specifically, as illustrated in FIG. 27, the flow resistance adjustment mechanisms are disposed between the negative pressure control unit and the second circulation pump 1004. In this way, R3 may be adjusted. In a configuration illustrated in FIG. 27, the flow resistance adjustment mechanisms are incorporated in a liquid supply unit 220 included in a liquid ejection head. However, the same effect may be obtained when the flow resistance adjustment mechanisms are disposed outside the liquid ejection head. In addition, a pressure source capable of controlling a pressure (for example, a water head tank, a case including a flexible wall and an air pump, etc.) may be used instead of the second circulation pump.

(Flow Resistance Adjustment Mechanism)

The flow resistance adjustment mechanism described in the above respective embodiments has a movable portion capable of changing a cross-sectional area of a passage or a length of the passage. In such a mechanism, in particular, it is possible to preferably use a mechanism that varies the cross-sectional area of the passage, for example, a needle valve, or a mechanism that has a flexible film in a portion of the passage and may vary the cross-sectional area of the passage.

Specifically, as illustrated in FIG. 24C, the flow resistance adjustment mechanism 222 has a mode in which an adjustment bolt 224 to which a seal material 226 is slidably attached is inserted into a passage from which a female screw portion 225 is cut in advance. In this configuration, a place at which the passage has a small cross-sectional area (high-flow resistance portion) may be created by setting the amount, at which a distal end of the bolt is inserted into the passage, to be large. Inversely, a low flow resistance is obtained when the insertion amount of the bolt is set to be small. In the configuration illustrated in FIG. 24C, a screw shape is illustrated. However, a slidable O-ring, etc. may be used. In addition, although not illustrated in FIG. 24C, it is preferable to have a mechanism that fixes the adjustment bolt 224 after an adjustment in order to prevent a change in adjustment amount of the flow resistance. Specifically, a caulking structure that prevents rotation of the adjustment bolt 224, or a fixing method using an adhesive, etc. is preferably used.

FIG. 24C has a mode in which the flow resistance adjustment mechanism is disposed inside the negative pressure control unit. However, the effect of the invention may be obtained when the flow resistance adjustment mechanism is disposed inside a passage of the liquid supply unit or inside a passage on the main body side of the printing apparatus outside the liquid ejection head as illustrated in FIG. 2, FIG. 3, FIG. 26, and FIG. 27.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-003069 filed Jan. 8, 2016, and No. 2016-238889 filed Dec. 8, 2016, which are hereby incorporated by reference wherein in their entirety.

What is claimed is:

1. A liquid ejection apparatus that uses a liquid ejection head including at least one print element board, and ejects a liquid from the liquid ejection head, the liquid ejection apparatus comprising:

differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, wherein the differential pressure generating unit includes a pair of negative pressure control units having set pressures different from each other, the negative pressure control unit of a higher pressure side is connected to the supply passage, the negative pressure control unit of a lower pressure side is connected to the collection passage, and a liquid feed pump that feeds the liquid from the supply passage and the collection passage to a liquid receiving tank is connected to a downstream side of the supply passage and the collection passage.

2. The liquid ejection apparatus according to claim 1, wherein the differential pressure generating unit performs a circulation of the liquid with respect to the liquid ejection head through the supply passage and the collection passage.

3. The liquid ejection apparatus according to claim 1, wherein the liquid ejection head includes a plurality of ejection openings, the supply passage includes a common supply passage common to the plurality of ejection openings, and the collection passage includes a common collection passage common to the plurality of ejection openings.

4. The liquid ejection apparatus according to claim 3, wherein at least one of the pair of negative pressure control units is subjected to a higher pressure than the set pressure of said negative pressure control units from an upstream side of said negative pressure control unit, and the negative pressure control unit includes a first pressure chamber that communicates with the liquid receiving tank, a second pressure chamber having a variable volume, the second pressure chamber being connected to the common supply passage or the common collection passage, an opening portion through which the first pressure chamber and the second pressure chamber communicate with each other, a valve provided inside the first pressure chamber to vary a flow resistance between the first pressure chamber and the second pressure chamber, the valve being urged in a direction in which a gap between the opening portion and the valve is blocked, and a pressure receiving portion allowed to be shifted based on a pressure variation of the second pressure chamber, the pressure receiving portion varying a position of the valve together with an urging force acting on the valve by delivering the shift to the valve.

5. The liquid ejection apparatus according to claim 4, further comprising a negative pressure adjustment member that changes the urging force acting on the valve in the at least one of the pair of negative pressure control units.

6. The liquid ejection apparatus according to claim 4, wherein the at least one of the pair of negative pressure control units includes a spring for urging the pressure receiving portion, and satisfies an expression below when a spring constant of the spring is set to k1, and a change rate of a pressure acting on the valve from an upstream of the valve with respect to a flow amount is set to R2, $$R2>k1/Sv\cdot da/dQ$$

here "a" denotes a valve opening position, Q denotes a flow amount, and Sv denotes a pressure receiving area for a pressure acting on the valve.

7. The liquid ejection apparatus according to claim 6, further comprising second flow resistance adjustment unit in at least one of passages between the liquid receiving tank and the respective pair of respective negative pressure control units.

8. The liquid ejection apparatus according to claim 1, wherein the flow resistance adjustment unit has a movable portion capable of changing a cross-sectional area of the passage or a length of the passage.

9. A liquid ejection apparatus that uses a liquid ejection head including at least one print element board, and ejects a liquid from the liquid ejection head, the liquid ejection apparatus comprising:

differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, wherein the differential pressure generating unit includes a pair of negative pressure control units having set pressures different from each other, a high pressure side thereof is connected to the supply passage, a low pressure side thereof is connected to the collection passage, and a liquid feed pump that feeds the liquid from a liquid receiving tank to the supply passage and the collection passage is connected to an upstream side of the supply passage and the collection passage.

10. The liquid ejection apparatus according to claim 9, wherein the liquid ejection head includes a plurality of ejection openings, the supply passage includes a common supply passage common to the plurality of ejection openings, and the collection passage includes a common collection passage common to the plurality of ejection openings.

11. The liquid ejection apparatus according to claim 10, wherein at least one of the pair of negative pressure control units is subjected to a lower pressure than the set pressure of said negative pressure control units from a downstream side of said negative pressure control unit, and the negative pressure control unit includes a first pressure chamber having a variable volume, the first pressure chamber being connected to the common supply passage or the common collection passage, a second pressure chamber that communicates with the liquid receiving tank, an opening portion through which the first pressure chamber and the second pressure chamber communicate with each other, a valve provided inside the first pressure chamber to vary a flow resistance between the first pressure chamber and the second pressure chamber, the valve being urged in a direction in which a gap between the opening portion and the valve is opened, and a pressure receiving portion allowed to be shifted based on a pressure variation of the first pressure chamber, the pressure receiving portion varying a position of the valve together with an urging force acting on the valve by delivering the shift to the valve.

12. The liquid ejection apparatus according to claim 11, wherein the at least one of the pair of negative pressure control units includes two springs for urging the pressure receiving portion, and satisfies an expression below when respective spring constants of the two springs are set to k1, k2, and a change rate of a pressure acting on the valve from a downstream of the valve with respect to a flow amount is set to R3, $$R3>(k1+k2)/Sv\cdot da/dQ$$

here "a" denotes a valve opening position, Q denotes a flow amount, and Sv denotes a pressure receiving area for a pressure acting on the valve.

13. The liquid ejection apparatus according to claim 12, further comprising second flow resistance adjustment unit in at least one of passages between the liquid receiving tank and the pair of respective negative pressure control units.

14. A method of supplying a liquid in a liquid ejection apparatus that uses a liquid ejection head and ejects a liquid from the liquid ejection head, the liquid ejection apparatus including differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, the method comprising:

a first step of measuring a pressure at an inlet portion of the supply passage and/or the collection passage at a first flow amount;

a second step of measuring a pressure at the inlet portion of the supply passage and/or the collection passage at a second flow amount larger than the first flow amount; and a third step of adjusting a flow resistance in a passage from a negative pressure control unit of the differential pressure generating unit to the inlet portion of the supply passage and/or the inlet portion of the collection passage using the flow resistance adjustment unit such that the pressure at the inlet portion of the supply passage and/or the collection passage at the second flow amount approaches the pressure at the first flow amount, wherein the liquid is supplied by the differential pressure generating unit at the pressure adjusted in the third step.

15. A method of supplying a liquid in a liquid ejection apparatus that uses a liquid ejection head and ejects a liquid from the liquid ejection head, the liquid ejection apparatus including differential pressure generating unit that includes a supply passage of the liquid supplied to the print element board and a collection passage of the liquid collected from the print element board, and is configured to generate a difference between a pressure of the liquid in the supply passage and a pressure of the liquid in the collection passage to perform a supply and a collection of the liquid; and flow resistance adjustment unit provided in the supply passage and/or the collection passage, the method comprising:

a first step of measuring a pressure at an outlet of the supply passage and/or the collection passage at a first flow amount;

a second step of measuring a pressure at the outlet of the supply passage and/or the collection passage at a second flow amount larger than the first flow amount; and a third step of adjusting a flow resistance in a passage from a negative pressure control unit of the differential pressure generating unit to the outlet of the supply passage and/or the outlet of the collection passage using the flow resistance adjustment unit such that the pressure at the outlet of the supply passage and/or the collection passage at the second flow amount approaches the pressure at the first flow amount, wherein the liquid is supplied by the differential pressure generating unit at the pressure adjusted in the third step.

16. A page wide type liquid ejection head comprising:

a support member;

a plurality of print element boards arranged on the support member, each print element board including a print element that generates energy used to eject a liquid;

differential pressure generating unit that includes a supply passage of the liquid supplied to the print element boards and a collection passage of the liquid collected from the print element boards, and is configured to generate a difference between a pressure of the liquid in the supply passage and a pressure of the liquid in the collection passage to perform a supply and a collection of the liquid; and flow resistance adjustment unit provided in the supply passage and/or the collection passage;

wherein the support member includes the supply passage and the collection passage, the supply passage includes a common supply passage for supplying the liquid to the plurality of the print element boards, and the collection passage includes a common collection passage for collecting the liquid from the plurality of the print element boards.

17. The liquid ejection head according to claim 16, wherein the flow resistance adjustment unit includes a movable portion capable of changing a cross-sectional area of a passage or a length of the passage.

18. The liquid ejection head according to claim 16, wherein the differential pressure generating unit is provided at an upstream side of the common supply passage and the common collection passage, and the differential pressure generating unit includes a first pressure chamber, a second pressure chamber provided at a downstream side of the first pressure chamber and configured to be a variable volume, an opening portion through which the first pressure chamber and the second pressure chamber communicating with each other, a valve varying a flow resistance of a communicating portion between the first pressure chamber and the second pressure chamber, and being urged in a direction in which a gap between the opening portion and the valve is blocked, and a pressure receiving portion allowed to be shifted based on a pressure variation of the second pressure chamber, the pressure receiving portion varying a position of the valve together with an urging force acting on the valve by delivering the shift to the valve.

19. The liquid ejection head according to claim 18, wherein the differential pressure generating unit includes a spring for urging the valve, and satisfies an expression below when a spring constant of the spring is set to k1, and a change rate of a pressure acting on the valve from an upstream of the valve with respect to a flow amount is set to R2, $$R2>k1/Sv\cdot da/dQ$$

here "a" denotes a valve opening position, Q denotes a flow amount, and Sv denotes a pressure receiving area for a pressure acting on the valve.

20. The liquid ejection head according to claim 16, wherein the differential pressure generating unit is provided at a downstream side of the common supply passage and the common collection passage, and the differential pressure generating unit includes a first pressure chamber configured to be a variable volume, a second pressure chamber provided at a downstream side of the first pressure chamber, an opening portion through which the first pressure chamber and the second pressure chamber communicating with each other, a valve provided inside the first pressure chamber, varying a flow resistance of a communicating portion between the first pressure chamber and the second pressure chamber, and being urged in a direction in which a gap between the opening portion and the valve is opened, and a pressure receiving portion allowed to be shifted based on a pressure variation of the first pressure chamber, the pressure receiving portion varying a position of the valve together with an urging force acting on the valve by delivering the shift to the valve.

21. The liquid ejection head according to claim 20, wherein the differential pressure generating unit includes two springs for urging the valve, and satisfies an expression below when respective spring constants of the spring are set to k1, k2, and a change rate of a pressure acting on the valve from a downstream of the valve with respect to a flow amount is set to R3, $$R3>(k1+k2)/Sv\cdot da/dQ$$

here "a" denotes a valve opening position, Q denotes a flow amount, and Sv denotes a pressure receiving area for a pressure acting on the valve.

22. The liquid ejection head according to claim 16, further comprising a pressure chamber including the print element therein, wherein the liquid inside the pressure chamber is circulated between an inside and an outside of the pressure chamber through the supply passage and the collection passage.

* * * * *